US010537175B2

(12) United States Patent
Chen

(10) Patent No.: US 10,537,175 B2
(45) Date of Patent: Jan. 21, 2020

(54) ARMREST ADJUSTER

(71) Applicant: ATEC INTERNATIONAL TEAM CO., LTD., Taoyuan (TW)

(72) Inventor: Te-Chun Chen, Taoyuan (TW)

(73) Assignee: ATEC INTERNATIONAL TEAM CO., LTD., Taoyuan (TW)

( * ) Notice: Subject to any disclaimer, the term of this patent is extended or adjusted under 35 U.S.C. 154(b) by 41 days.

(21) Appl. No.: 15/835,785

(22) Filed: Dec. 8, 2017

(65) Prior Publication Data

US 2019/0174921 A1 Jun. 13, 2019

(51) Int. Cl.
*A47C 1/03* (2006.01)
*A47C 7/54* (2006.01)

(52) U.S. Cl.
CPC ..... *A47C 1/03* (2013.01)

(58) Field of Classification Search
CPC ..... A47C 1/03
USPC ..... 297/115, 116, 227, 281, 282, 286, 411.2, 297/411.32
See application file for complete search history.

(56) References Cited

U.S. PATENT DOCUMENTS 8,474,914 B2 7/2013 Chen et al.
2008/0073965 A1* 3/2008 Tsai ..... A47C 1/03 297/411.36

* cited by examiner

*Primary Examiner* — Justin V Lewis
(74) *Attorney, Agent, or Firm* — Muncy, Geissler, Olds & Lowe, P.C.

(57) ABSTRACT

An armrest adjuster is revealed. The armrest adjuster includes an armrest disposed on a top surface of an armrest support. The armrest consists of an armrest pad, an armrest base connected to an armrest cover of the armrest pad to form an armrest body, a first component, a second component fixed between the armrest base and the top surface of the armrest support and arranged with a projecting shaft thereof in the fore-and-aft direction, a first shaft cover, a second shaft cover, and at least one damper. The armrest can not only be changed between a button-free mode and a button mode easily, but also can be installed optionally for adjustment in fore-and-aft direction or lateral direction, or rotation from side to side, with/or without damping action. Thereby the armrest is easy to be installed and the side-view height of the armrest can be reduced.

10 Claims, 22 Drawing Sheets

ARMREST ADJUSTER

BACKGROUND OF THE INVENTION

The present invention relates to an armrest adjuster, especially to an armrest adjuster by which an armrest not only can be changed between a button-free mode and a button mode easily, but also can be installed optionally for movement and adjustment in the fore-and-aft direction or the lateral direction, or rotation from side to side, with/or without damping action.

There are many armrest adjusters available now such as U.S. Pat. No. 8,474,914 B2. However, there is room for improvement for the armrest available now.

Firstly, users sit on chairs usually work or play games by electronics (such as smartphones, tablet computers, etc.) on their hands or laptops on their knees. The efficiency of the armrest can be increased greatly once the armrest (armrest body) set on each of two sides of the chair can be adjusted or moved (such as rotational adjustment) to the front side of the users for allowing users upper limbs (such as elbows) to lean against or allowing users to put the laptop. However, the conventional armrest is unable to meet the user's needs mentioned above.

Moreover, the armrest pad (armrest body) is usually connected to and disposed on a top surface of an armrest support. For rotational adjustment, and adjustment in the fore-and-aft direction and the lateral direction, the side view of the armrest pad (armrest body) should have a certain height. Thus not only the types of the armrest support used are limited, the appearance of the whole chair is affected. The purchase intension of manufacturers of the chair manufacturers/or the armrest support to the chair armrest is also under influence of the height.

Although certain types of conventional armrest provide rotational adjustment, and adjustment in the fore-and-aft direction and the lateral direction, these armrests are divided into two control modes-a button control mode (such as a press member 90 of the present invention) and a button-free control mode. As to the armrest with the button, users need to press the button first for adjustment in various directions. On the other hand, users can adjust the armrest directly and freely without pressing any button once they sit on the chair with button-free armrests. For manufacturers, the conventional armrests have different structure, unable to be replaced by each other easily according to user's needs. Thus the manufacturing cost is increased and this has negative effects on production management of manufacturing ends or suppliers.

Lastly, plurality of metal fasteners (such as screws) is required to assembly the conventional armrest. Thus the installation of the armrest is not simple. The increased number of the metal parts and accessories results in higher assembly cost. This is not good for the environment.

In order to solve the above problems, there is a need to provide a novel armrest adjuster.

SUMMARY OF THE INVENTION

Therefore it is a primary object of the present invention to provide a button-free armrest adjuster by which an armrest body can be moved and adjusted relative to a projecting shaft in the fore-and-aft direction or the lateral direction, or rotated relative to the projecting shaft from side to side, with/or without damping action. The side-view height of the armrest body is reduced easily and the installation of the armrest body is convenient.

In order to achieve the above object, a button-free armrest adjuster according to the present invention includes an armrest disposed on a top surface of an armrest support. The armrest consists of an armrest pad, an armrest base connected to an armrest cover of the armrest pad correspondingly to form an armrest body, a first component, a second component fixed between the armrest base and the top surface of the armrest support, a first shaft cover, a second shaft cover, and at least one damper. A rectangular space is formed within the armrest body while a projecting shaft is disposed on a center of the second component along the fore-and-aft direction. While in use, the projecting shaft remains stationary while the armrest body is moved and adjusted in fore-and-aft direction or lateral direction, or rotated from side to side, with/or without damping action so as to achieve the side-view height adjustment and easy installation thereof.

It is another object of the present invention to provide an armrest adjuster with a button by which an armrest body can be moved and adjusted relative to a projecting shaft in the fore-and-aft direction or the lateral direction, or rotated relative to the projecting shaft from side to side, with/or without damping action. The side-view height of the armrest body is reduced easily and the installation of the armrest body is convenient.

In order to achieve the above object, an armrest adjuster with a button according to the present invention includes an armrest disposed on a top surface of an armrest support. The armrest consists of an armrest pad, an armrest base connected to an armrest cover of the armrest pad correspondingly to form an armrest body, a first component, a second component fixed between the armrest base and the top surface of the armrest support, a first shaft cover, a second shaft cover, and at least one damper. A rectangular space is formed within the armrest body while a projecting shaft is disposed on a center of the second component along the fore-and-aft direction. The armrest further includes a press member, a control member and a fastener. The press member is disposed with a third rack in the fore-and-aft direction for being engaged with a fourth rack of the first component. The third rack of the press member is released from the fourth rack of the first component when a press portion of the press member is pressed and moved away from an opening while in use. At the moment, the projecting shaft keeps stationary and the armrest body can be moved and adjusted relative to the projecting shaft in fore-and-aft direction or lateral direction, or rotation from side to side, with/or without damping action optionally. The third rack of the press member is returned to be engaged with the fourth rack of the first component when the press portion of the press member is released and returned elastically. Now a slide bar of the press member also drives the control member to move outward elastically and turn back to the original position. Thus the fastener is also returned elastically and a sixth rack is engaged with a second rack of the first shaft cover and teeth around the second shaft cover simultaneously. Thereby the armrest is turned back to the fixed state, being positioned.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1:
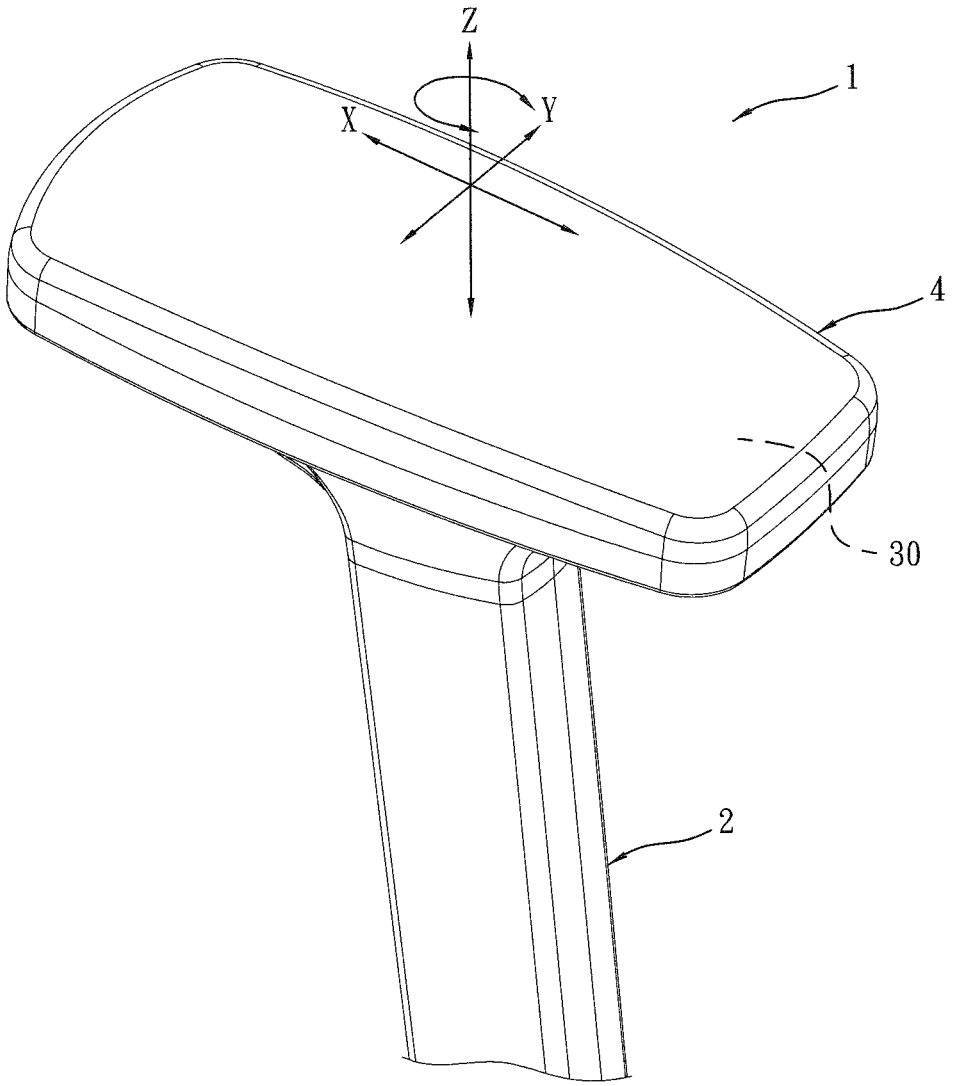
FIG. 1 is a perspective view of an embodiment (button-free) according to the present invention.
Figure 2:
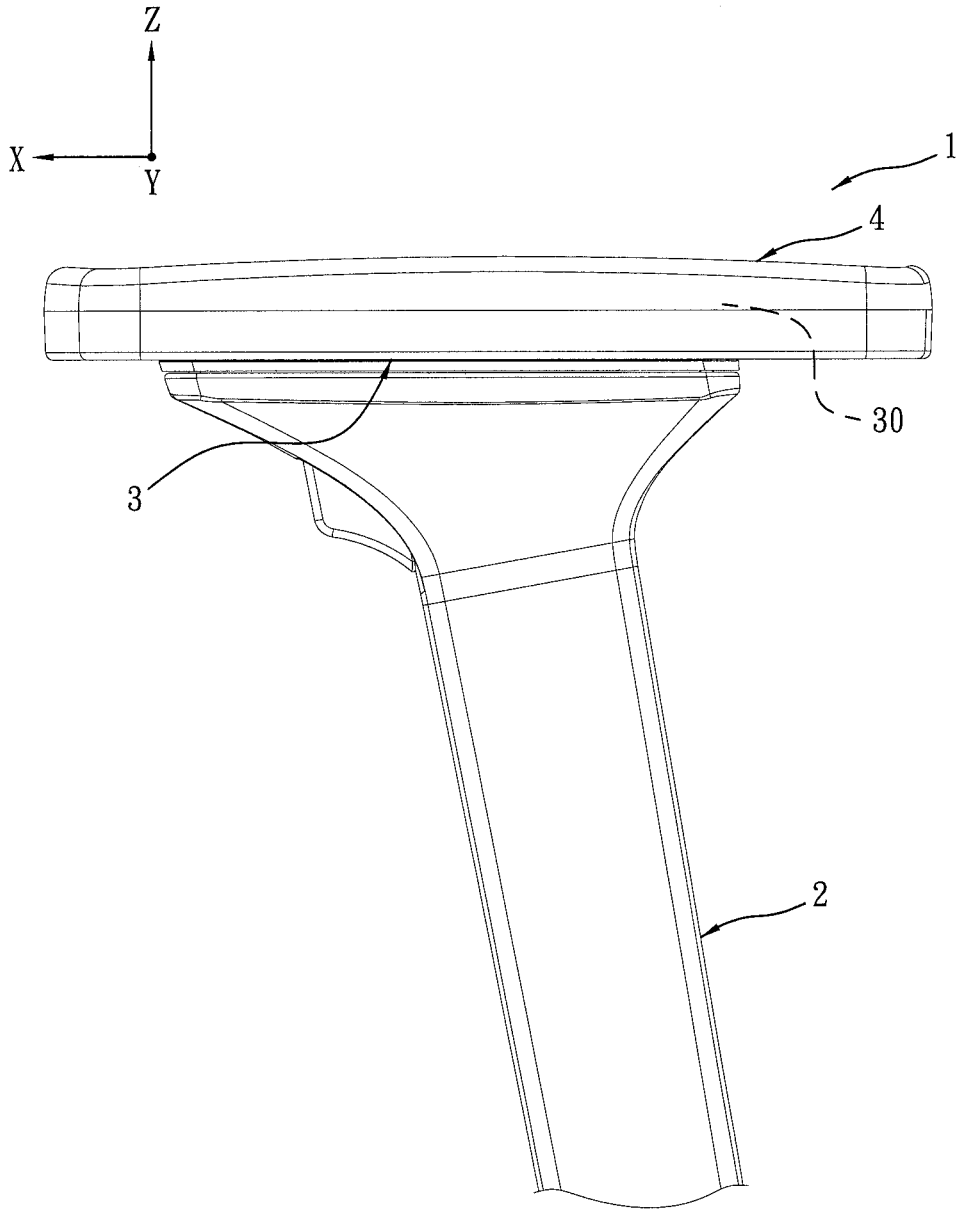
FIG. 2 is a side view of the embodiment in FIG. 1 according to the present invention.
Figure 3:
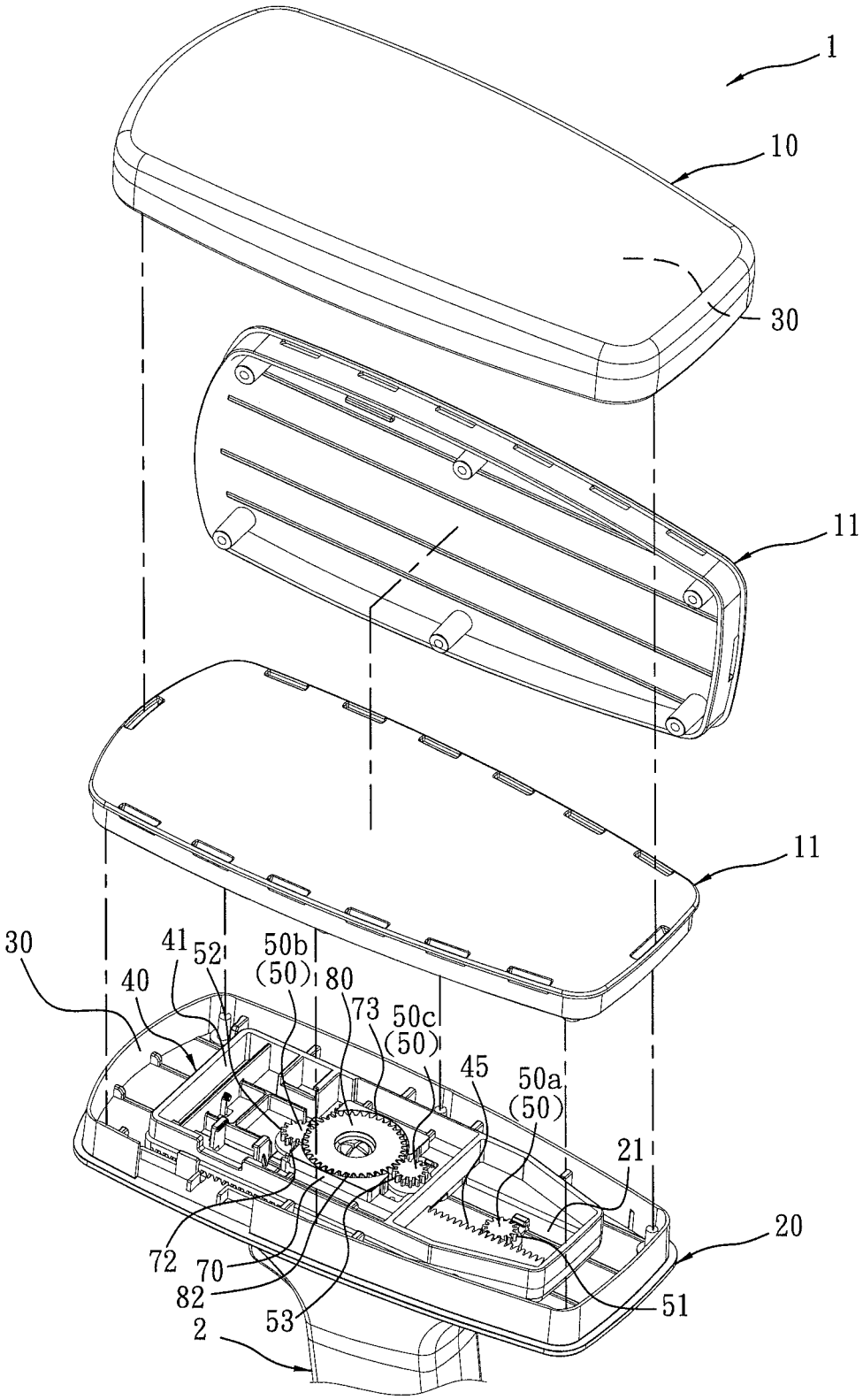
FIG. 3 is an explosive view of the embodiment in FIG. 1 according to the present invention.
Figure 4:
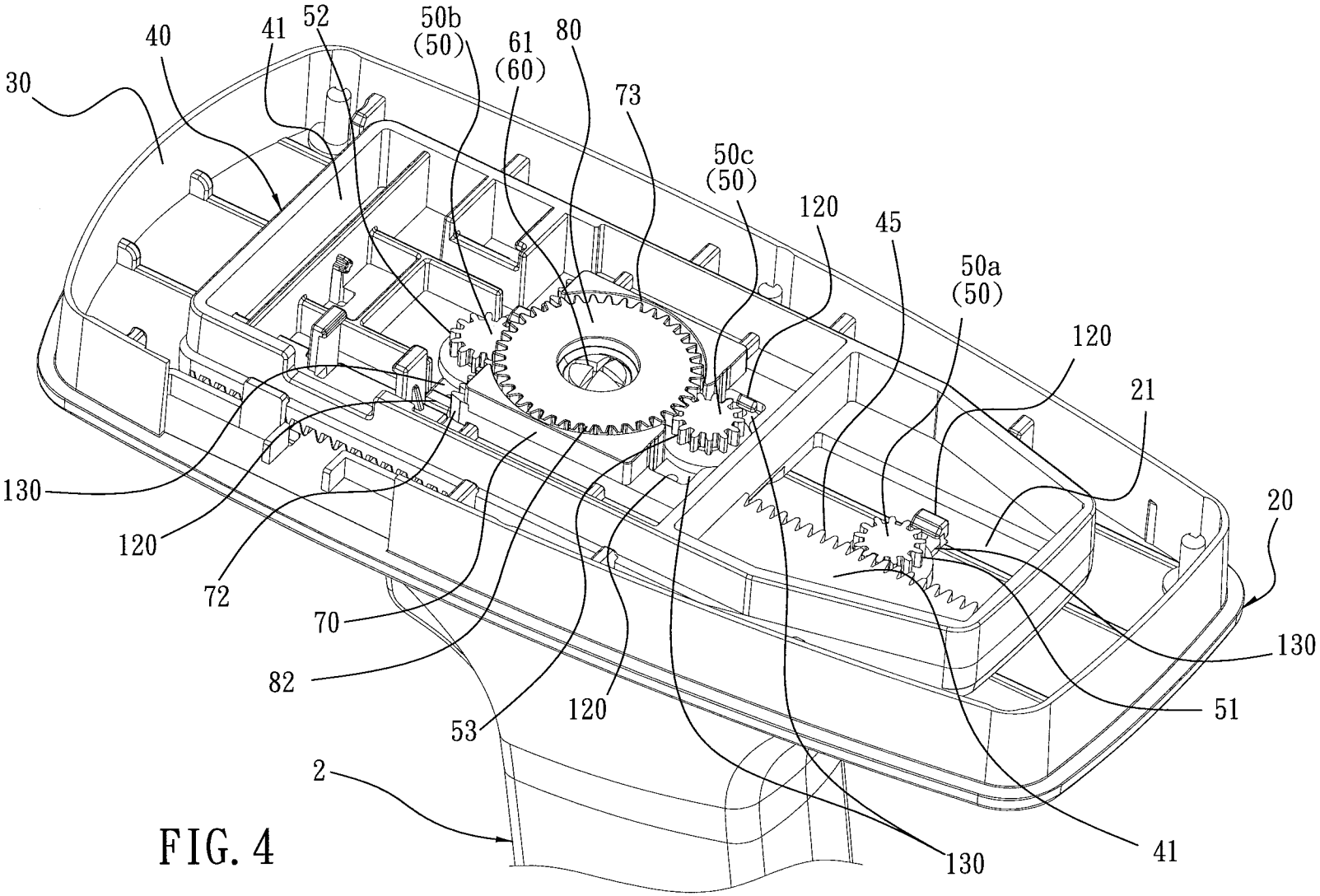
FIG. 4 is a partial enlarged view of the embodiment in FIG. 3 according to the present invention.

Refer from FIG. 1 to FIG. 10, a button-free armrest adjuster according to the present invention includes an armrest 1 being set on a top surface 3 of an armrest support 2. The armrest 1 consists of an armrest pad 10, an armrest base 20, a first component 40, at least one damper 50, a second component 60, a first shaft cover 70 and a circular second shaft cover 80.

The armrest pad 10 is fixed with an armrest cover 11 therein and the armrest cover 11 is used for preventing each component within the armrest base 20 from releasing from its original position. Thus the failure of the armrest 1 caused by abnormal displacement of one component can be avoided.

The armrest base 20 is connected to the armrest cover 11 of the armrest pad 10 correspondingly to form an armrest body 4. A rectangular space 30 is formed within the armrest body 4 while a first long slot 21 is arranged at a middle part of the armrest base 20 in fore-and-aft direction (such as the X axis in figure), as shown in FIG. 6.

Figure 6:
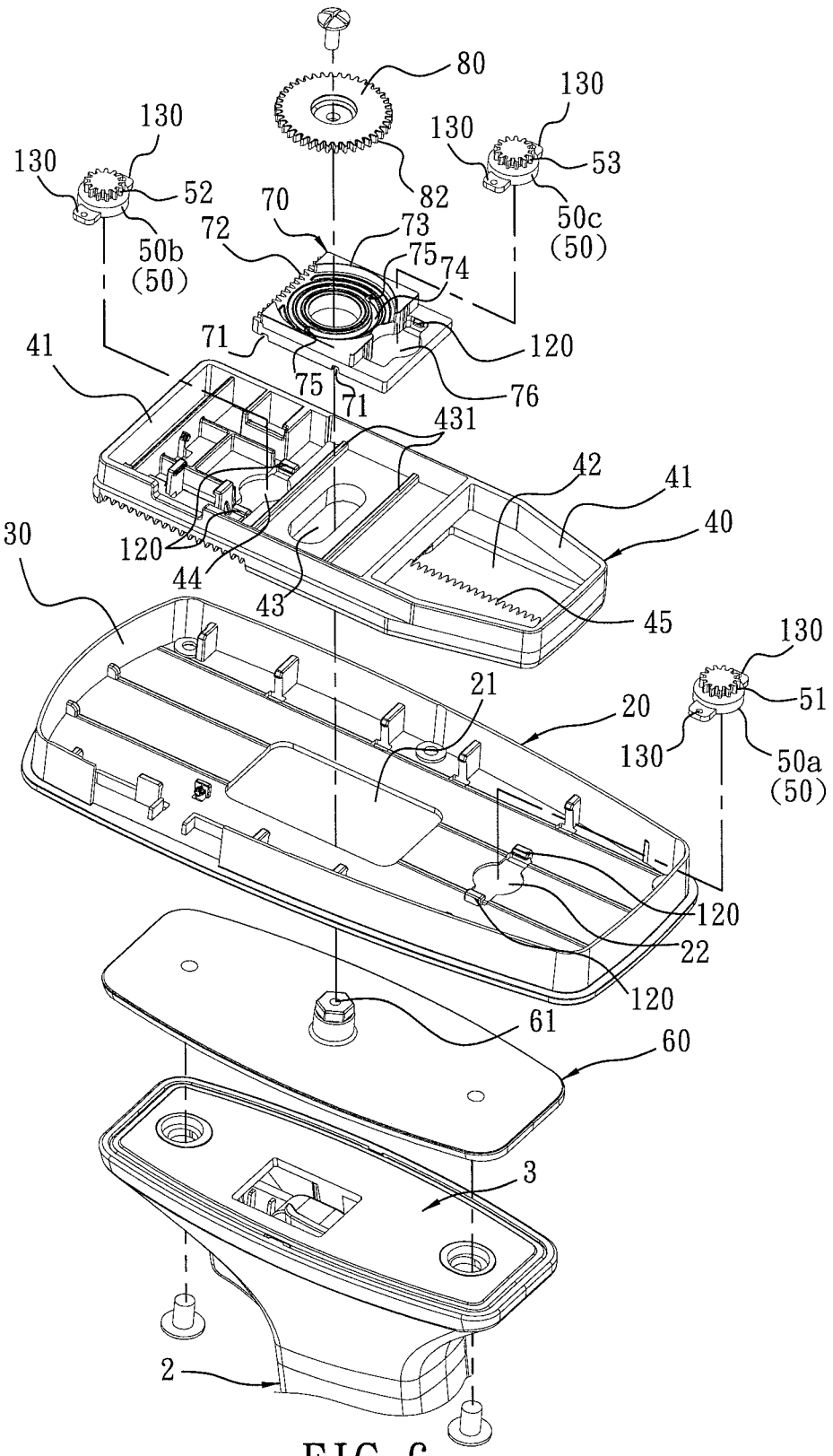
FIG. 6 is an explosive view of the embodiment in FIG. 4 according to the present invention.
Figure 7:
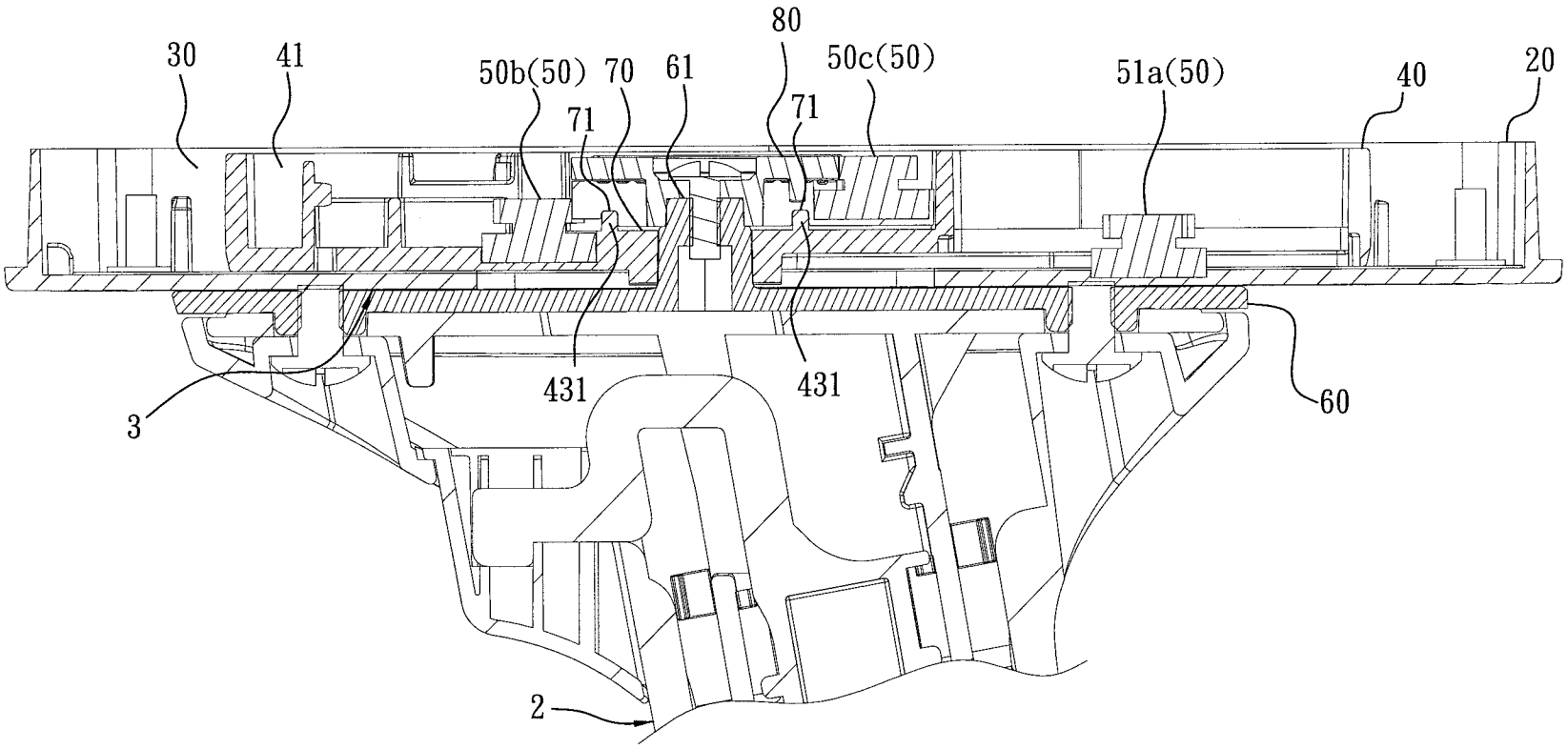
FIG. 7 is a sectional view of the embodiment in FIG. 5 according to the present invention.

Refer to the FIG. 6, the first component 40 is mounted in the rectangular space 30 of the armrest body 4 and having a first recess 41. A fore-and-aft second long slot 42 and a third long slot 43 along the lateral direction (such as the Y axis in figure) are disposed separately in the first recess 41. The third long slot 43 is set over the first long slot 21.

Still the FIG. 6, the second component 60 is fixed between the armrest base 20 and the top surface 3 of the armrest support 2. A projecting shaft 61 is set on a center of the second component 60 along the fore-and-aft direction. The projecting shaft 61 is passed through both the first long slot 21 of the armrest base 20 and the third long slot 43 of the first component 40.

Figure 9:
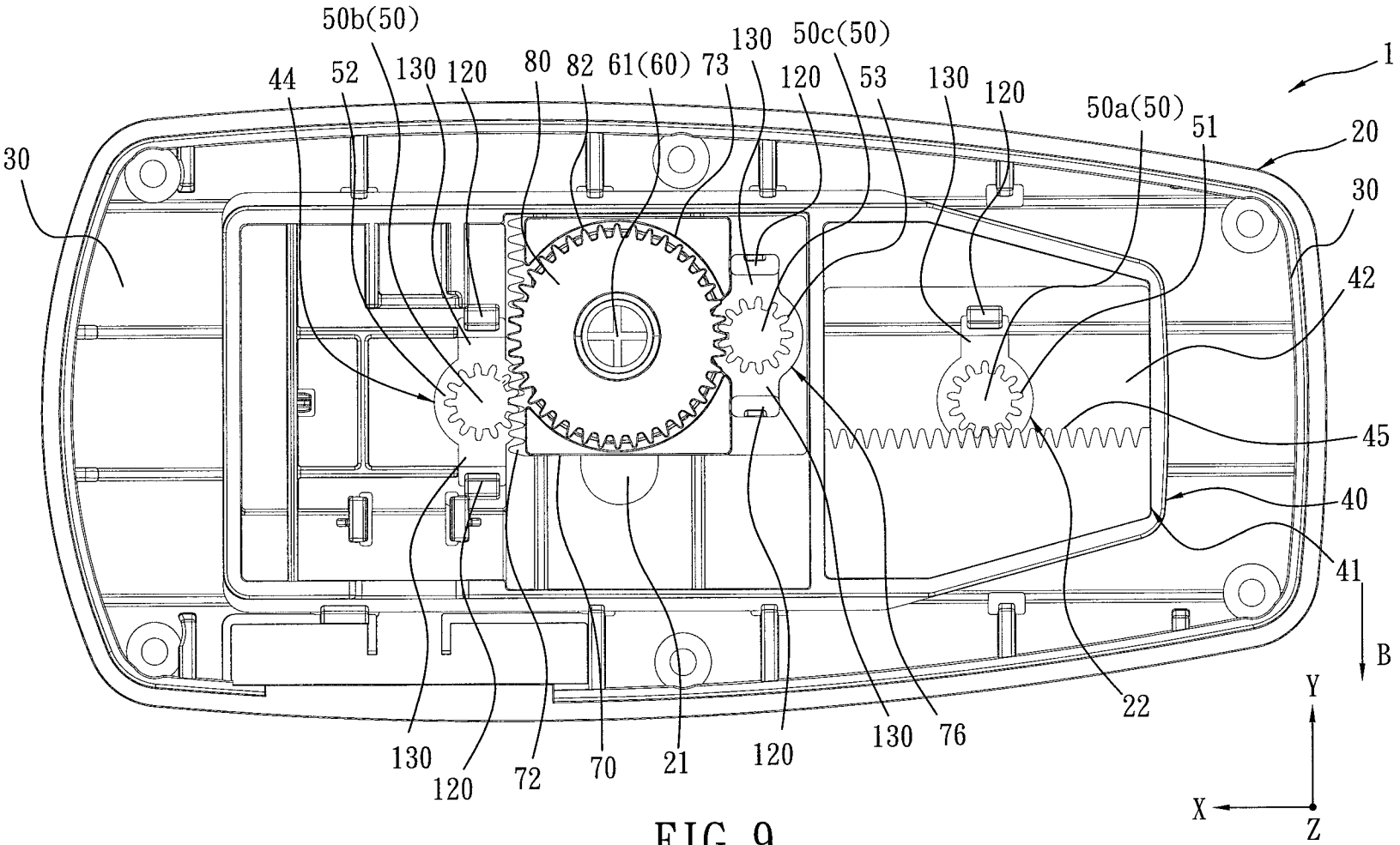
FIG. 9 is a top view of the embodiment in FIG. 8 being adjusted for left-and-right adjustment according to the present invention.

The first shaft cover 70 is arranged at the projecting shaft 61 of the second component 60 and is located over the third long slot 43 of the first component 40, as shown in FIG. 6. Thus the first component 40 can be slid relative to the first shaft cover 70 in the lateral direction, as shown in FIG. 9.

Figure 10:
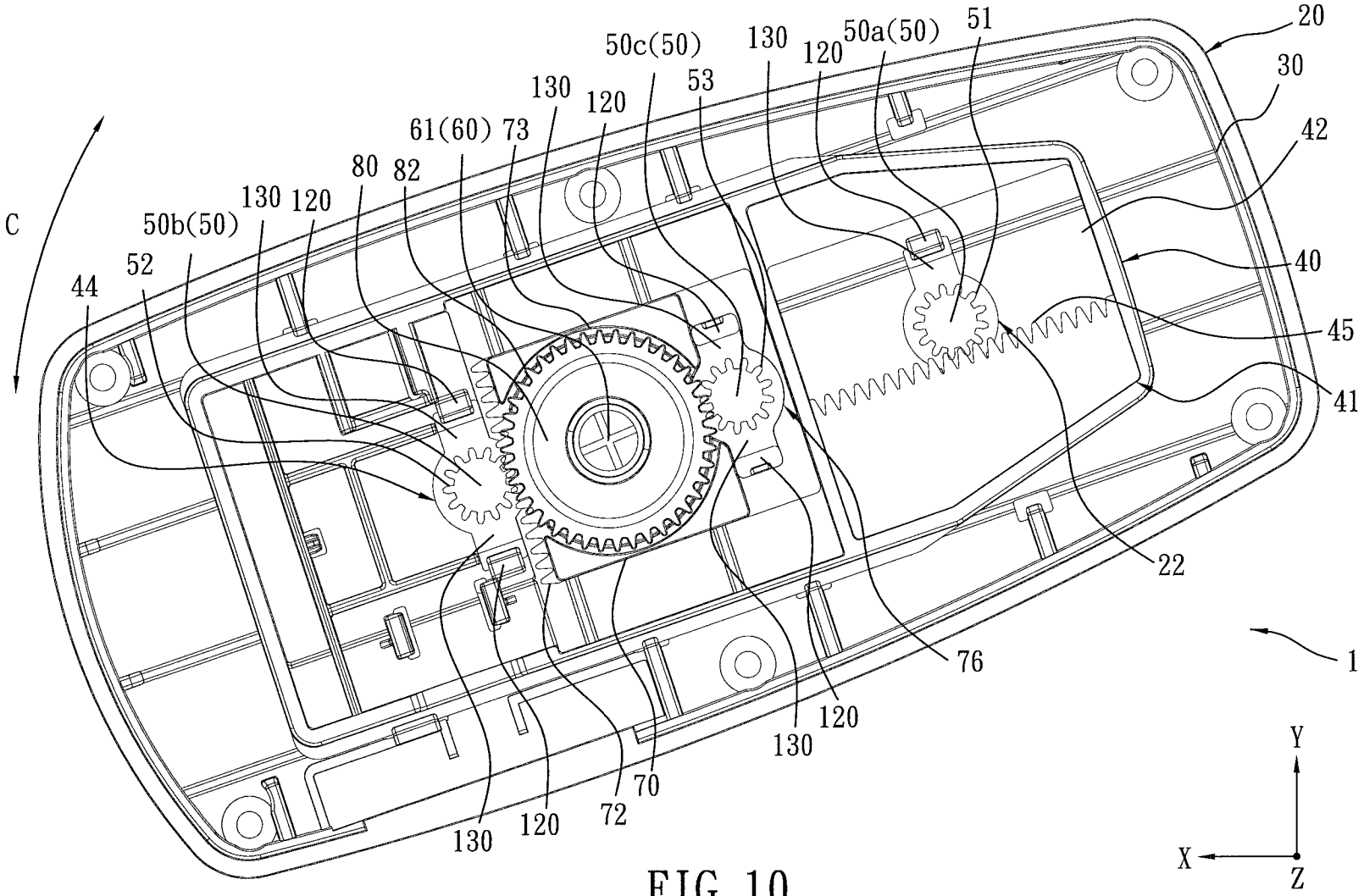
FIG. 10 is a top view of the embodiment in FIG. 5 being rotated and adjusted from side to side according to the present invention.
Figure 11:
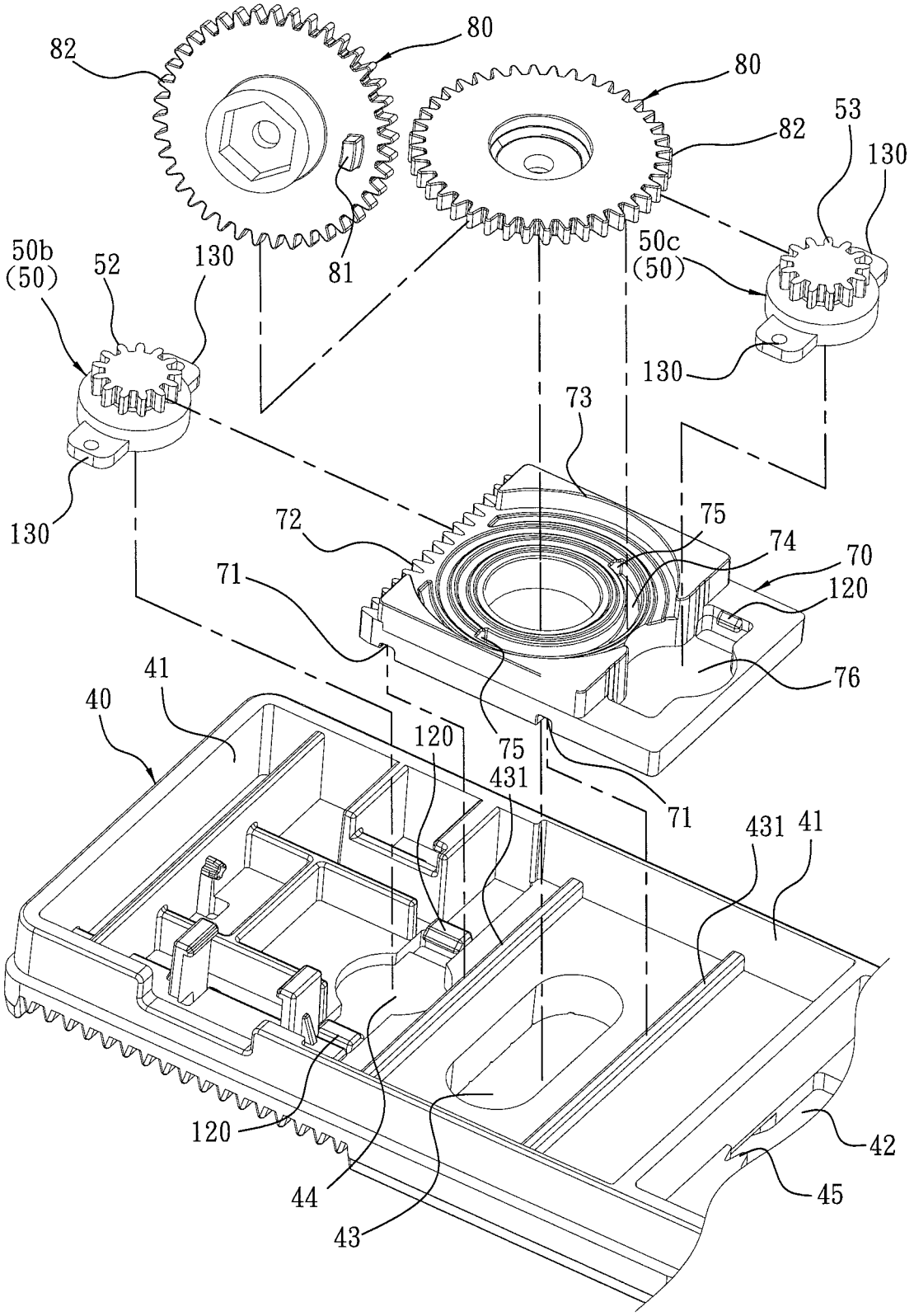
FIG. 11 is a partial enlarged explosive view of the embodiment in FIG. 6 according to the present invention.
Figure 12:
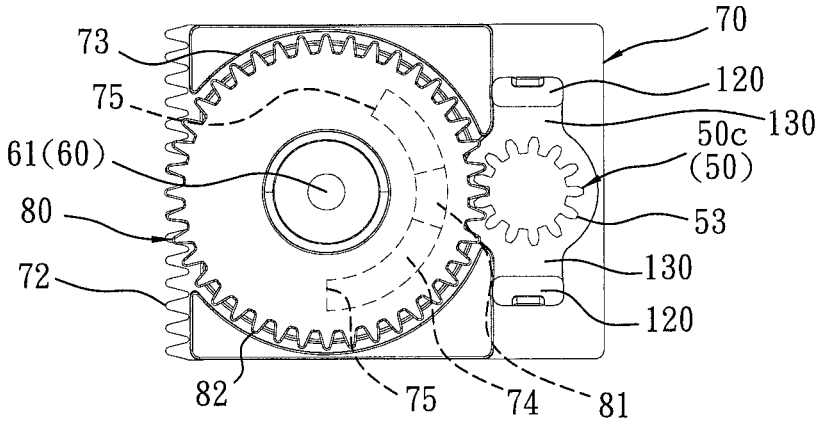
FIG. 12 is a schematic drawing showing a top view of an embodiment in which a first shaft cover remains stationary over a second shaft cover according to the present invention.
Figure 14:
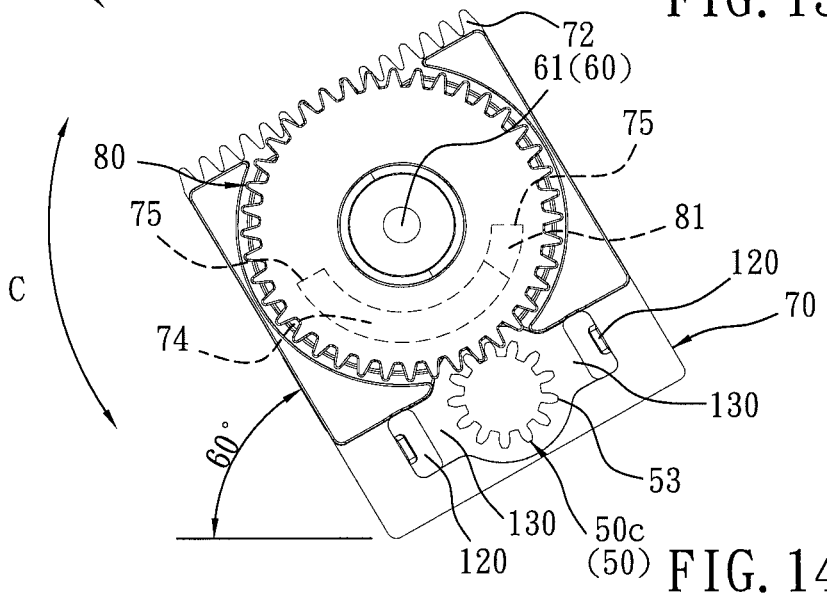
FIG. 14 is a schematic drawing showing a top view of the embodiment in FIG. 12 in which a first shaft cover is rotated 60 degrees over a second shaft cover according to the present invention.

The second shaft cover 80 is rotatably mounted in a circular recess 73 on the top surface of the first shaft cover 70 and is also fixed on the projecting shaft 61 of the second component 60, as shown in FIG. 6. Refer to FIG. 10, FIG. 12 and FIG. 14, the second shaft cover 80 remains stationary while the first shaft cover 70 is rotated with respect to the second shaft cover 80 when the armrest body 4 is rotated and moved relative to the projecting shaft 61 for adjusting the angle thereof. Thus the armrest body 4, the first component 40 and the first shaft cover 70 are synchronously rotated and moved relative to the second shaft cover 80 for adjustment and finally are positioned at an angle after rotation.

Figure 8:
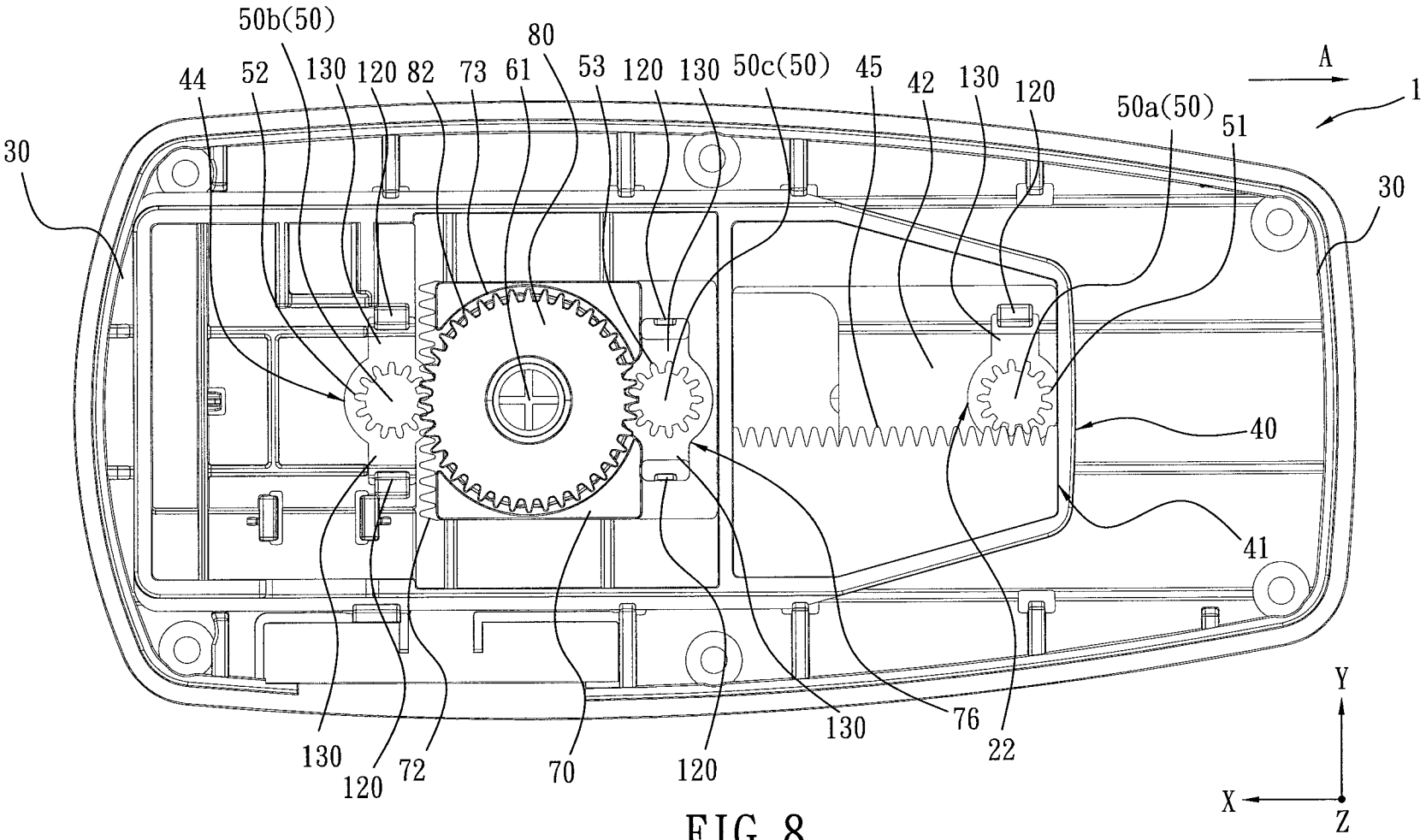
FIG. 8 is a top view of the embodiment in FIG. 5 being moved for fore-and-aft adjustment according to the present invention.

Refer to FIG. 8, the damper 50 is selected from the followings: a first damper 50*a*, a second damper 50*b*, a third damper 50*c*, and a combination thereof. The manufacturers can install one of the dampers 50*a*, 50*b*, 50*c*, two of them or all the three dampers according to their requirements (such as in consideration of cost).

Figure 5:
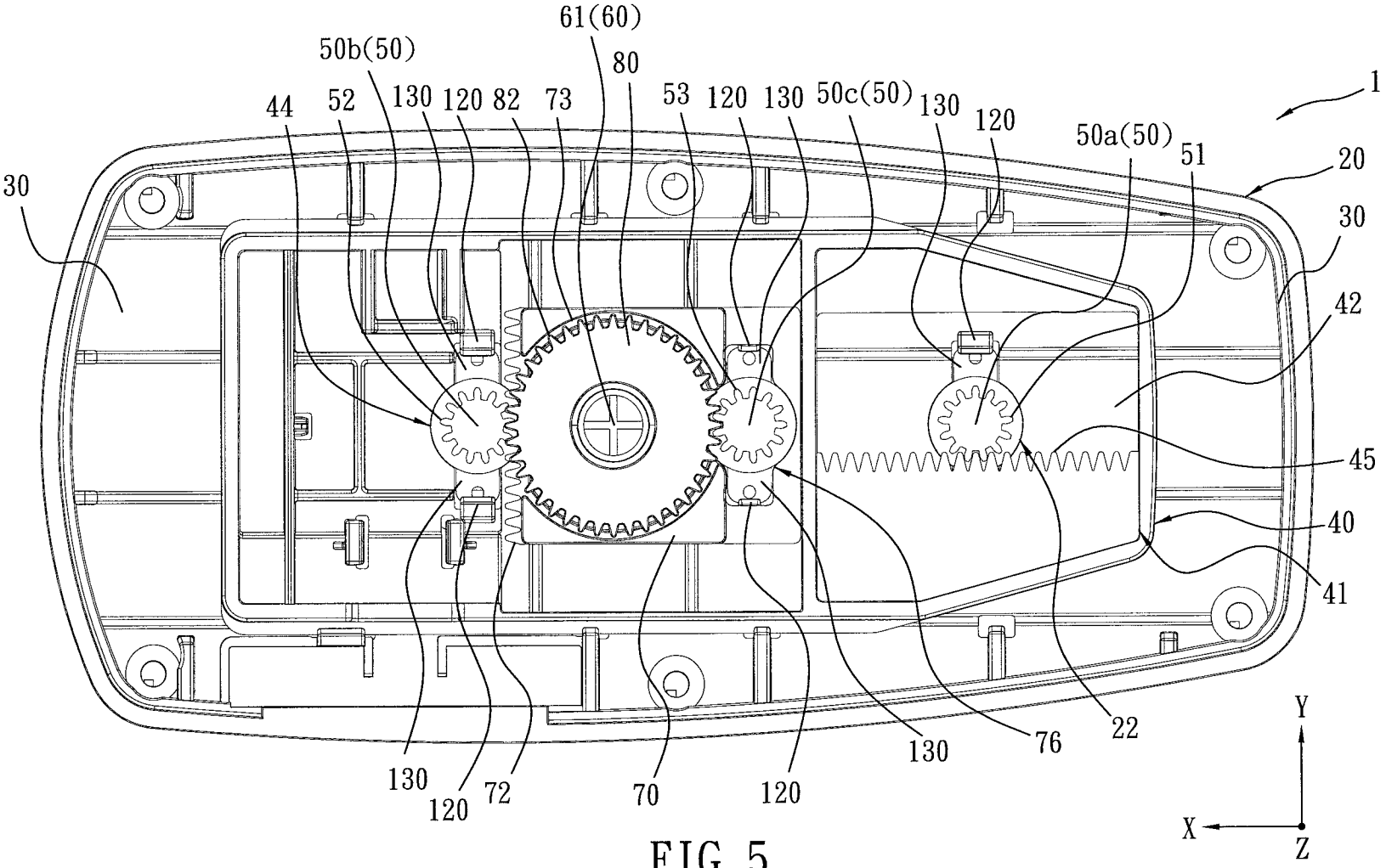
FIG. 5 is a top view of the embodiment in FIG. 4 according to the present invention.

Refer to FIG. 5 and FIG. 6, the armrest base 20 is arranged with a first groove 22 located beside the first long slot 21 along the fore-and-aft direction and a first damper 50*a* is mounted in the first groove 22 when the damper 50 is the first damper 50*a*. A first rack 45 is disposed on one side of the second long slot 42 along the fore-and-aft direction. A first rotary damper 51 of the first damper 50*a* is passed through the second long slot 42 of the first component 40 to be engaged with the first rack 45.

Refer to FIG. 5 and FIG. 6, the first recess 41 of the first component 40 is disposed with a second groove 44 and a second damper 50*b* is mounted in the second groove 44 when the damper 50 is the second damper 50*b*. A second rotary damper 52 of the second damper 50*b* is engaged with a second rack 72 on one lateral side of the first shaft cover 70.

Refer to FIG. 5 and FIG. 6, the first shaft cover 70 is set with a third groove 76 and a third damper 50*c* is mounted in the third groove 76 when the damper 50 is the third damper 50*c*. A third rotary damper 53 of the third damper 50*c* is engaged with teeth 82 set circularly around the second shaft cover 80.

The projecting shaft 61 remains stationary and the first rotary damper 51 of the first damper 50*a* is engaged with and moved along the first rack 45 when the armrest body 4 is adjusted forward and backward in the fore-and-aft direction. Thus the armrest body 4 is moved and adjusted relative to the projecting shaft 61 in the fore-and-aft direction with the damping action, as the arrow A in FIG. 8 indicates.

The projecting shaft 61 remains stationary and the second rotary damper 52 of the second damper 50*b* is engaged with and slid along the second rack 72 when the armrest body 4 is adjusted in the lateral direction. Thus the armrest body 4 is moved and adjusted relative to the projecting shaft 61 in the lateral direction with the damping action, as the arrow B in FIG. 9 indicates.

Figure 13:
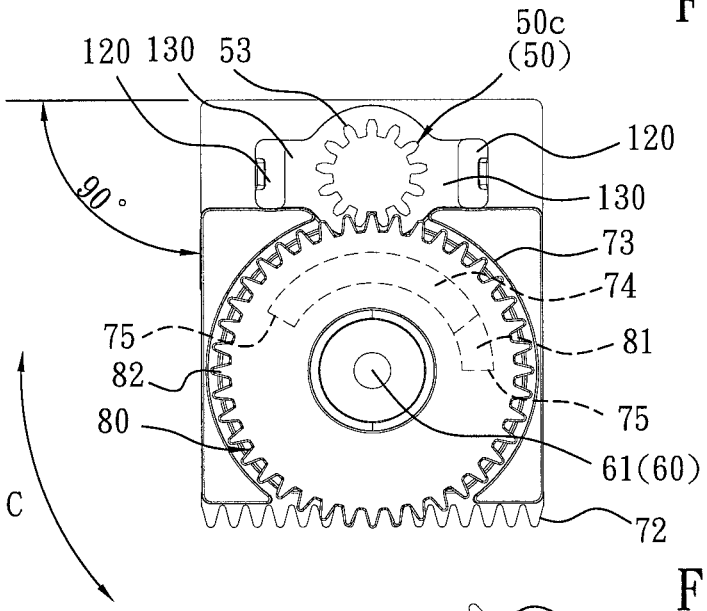
FIG. 13 is a schematic drawing showing a top view of the embodiment in FIG. 12 in which a first shaft cover is rotated 90 degrees over a second shaft cover according to the present invention.

The projecting shaft 61 remains stationary and the third rotary damper 53 of the third damper 50*c* is moved along the teeth 82 around the second shaft cover 80 when the armrest body 4 is rotated for adjustment. Thus the armrest body 4 is rotated and adjusted relative to the projecting shaft 61 with the damping action, as the arrow C in FIG. 10, FIG. 13, and FIG. 14 indicates.

Refer from FIG. 11 to FIG. 14, the circular recess 73 of the first shaft cover 70 is further arranged with a circular track 74 that is set around the projecting shaft 61 of the second component 60 (in the Z-axis shown in figure) after being assembled. Each of two ends of the circular track 74 is disposed with a first stopper 75. A positioning block 81 is set on the second shaft cover 80 and is mounted and slid in the circular track 74 correspondingly. The second shaft cover 80 stops rotating when the positioning block 81 is in contact with the first stopper 75. The angle that the circular track 74 subtends is limited so that the second shaft cover 80 is able to rotate between the two first stoppers 75 (within the limited angle).

Figure 26:
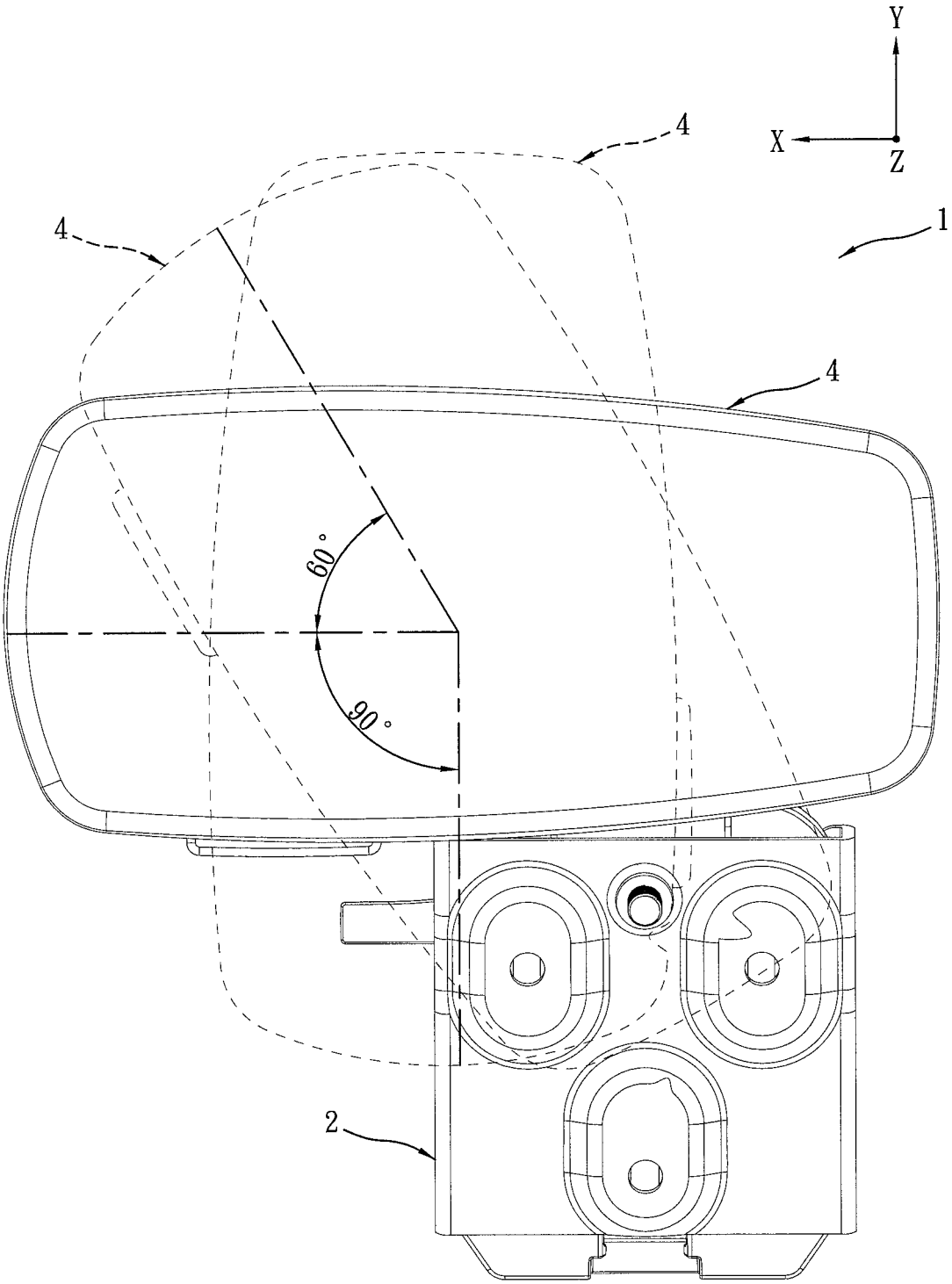
FIG. 26 is a schematic drawing showing a top view of an embodiment over an armrest support being rotated according to the present invention.

Refer to FIG. 12, FIG. 14 and FIG. 26, the armrest body 4, the first component 40 and the first shaft cover 70 are synchronously rotated and adjusted relative to the second shaft cover 80 and then to be positioned at the angle of 0°, 60° or 90° after rotation, but not limited to these angles.

Refer to FIGS. 4-6, FIG. 8-11, FIGS. 18-20, and FIG. 23, at least one locking part 120 is disposed on one lateral side of the first groove 22, the second groove 44 or the third groove 76. The first damper 50*a*, the second damper 50*b*, or the third damper 50*c* is arranged with at least one locked part 310 being locked with the locking part 120 correspondingly. Thereby the first damper 50*a*, the second damper 50*b*, or the third damper 50*c* can be fixed on the first groove 22, the second groove 44 or the third groove 76 respectively and more stably by the locking part 120.

Refer to FIG. 6, FIG. 7, FIG. 11, FIG. 20, and FIG. 22, a front part or a rear part of the bottom surface of the first shaft cover 70 is disposed with at least one sliding groove 71 while at least one first sliding rail 431 corresponding to the sliding groove 71 is arranged at the first component 40. Thus the first shaft cover 70 can be set and slid over the first sliding rail 431 smoothly in the lateral direction by the sliding groove 71. The design ensures smooth sliding.

Refer to FIG. 15-23, an embodiment of an armrest adjuster with a button (press member) is revealed. The difference between this embodiment and the above one is in that this embodiment is further added with a press member 90, a control member 100 and a fastener 110. The armrest adjuster is further disposed with a button (press member).

Figure 15:
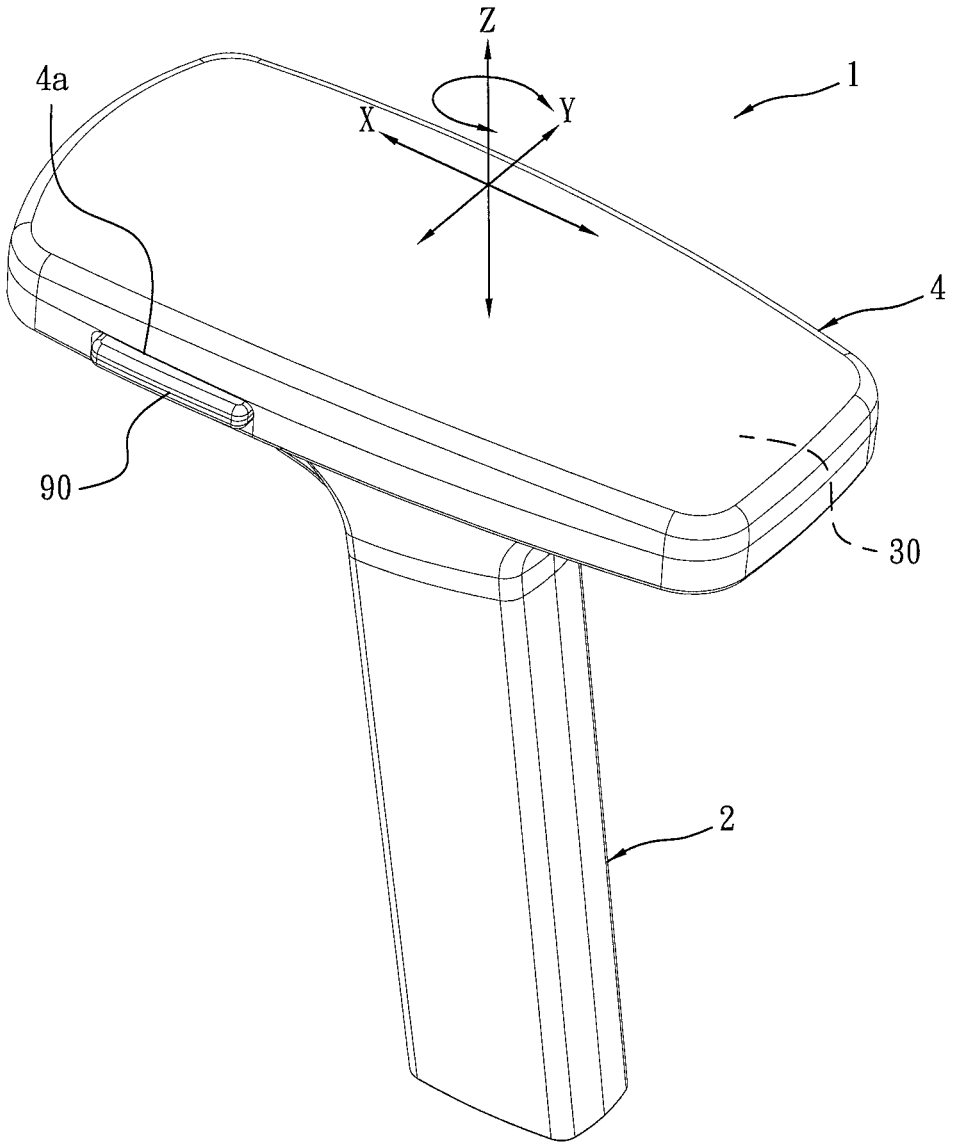
FIG. 15 is a perspective view of an embodiment (with at least one button) according to the present invention.
Figure 16:
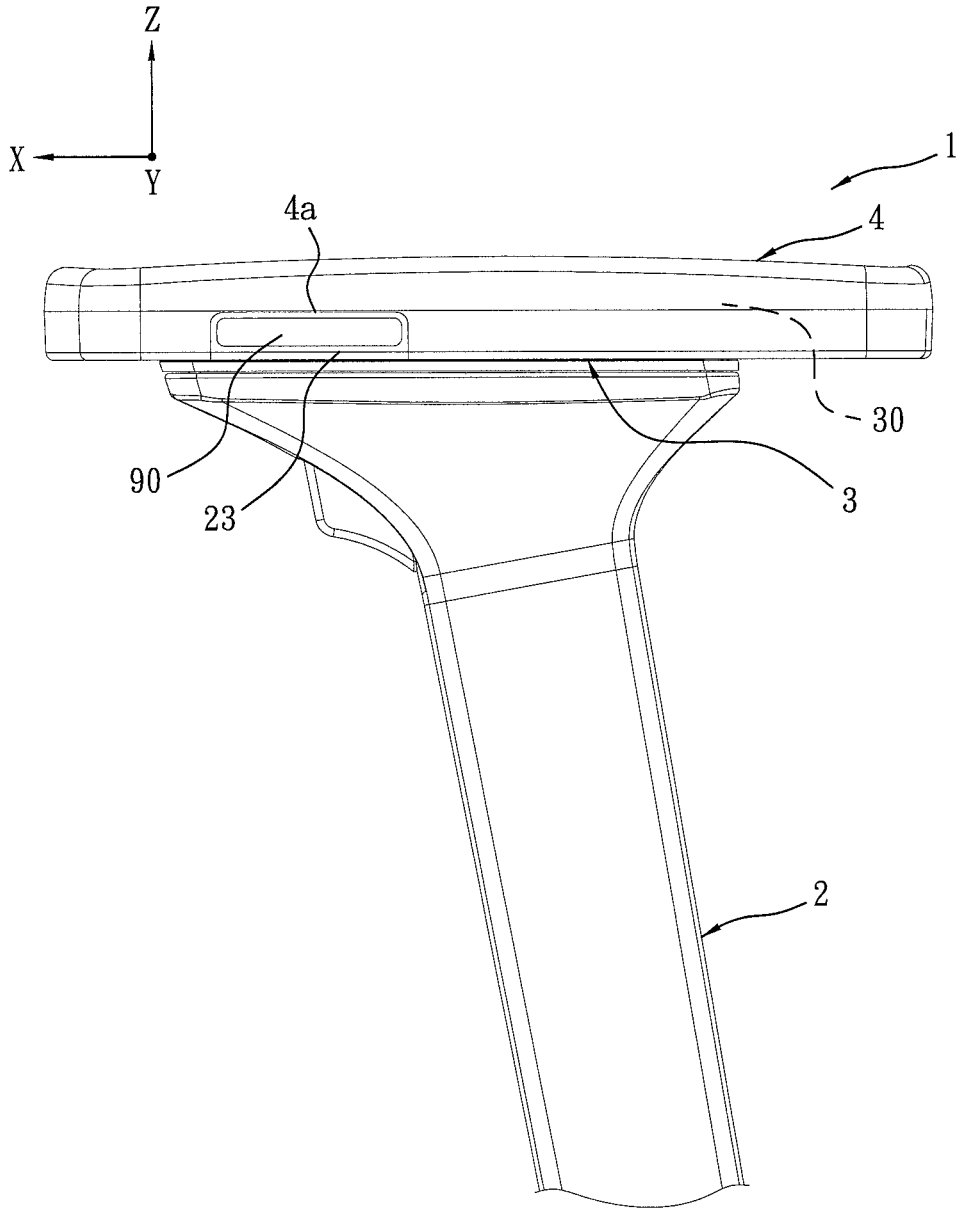
FIG. 16 is a side view of the embodiment in FIG. 15 according to the present invention.
Figure 20:
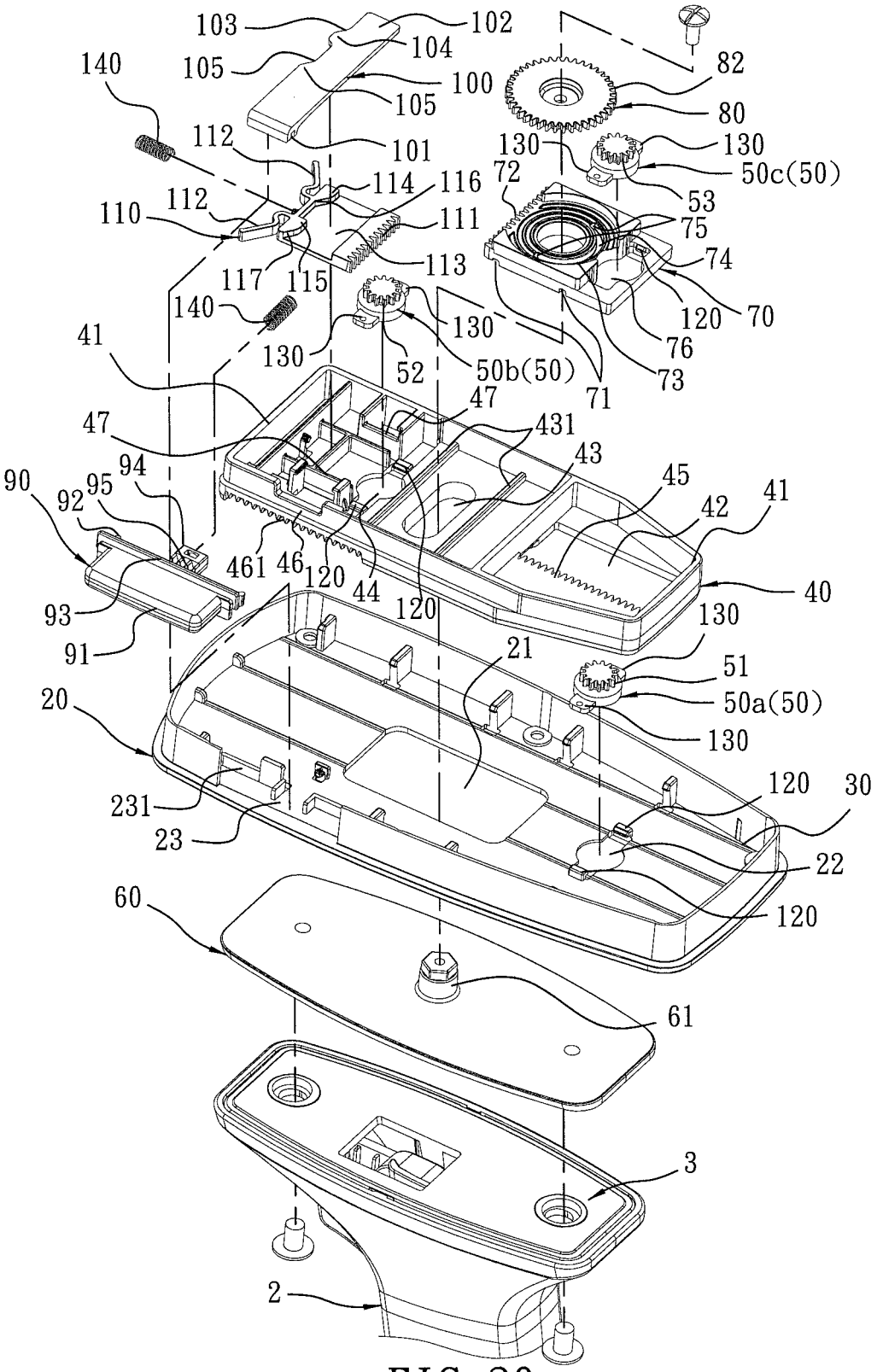
FIG. 20 is an explosive view of the embodiment in FIG. 18 according to the present invention.
Figure 22:
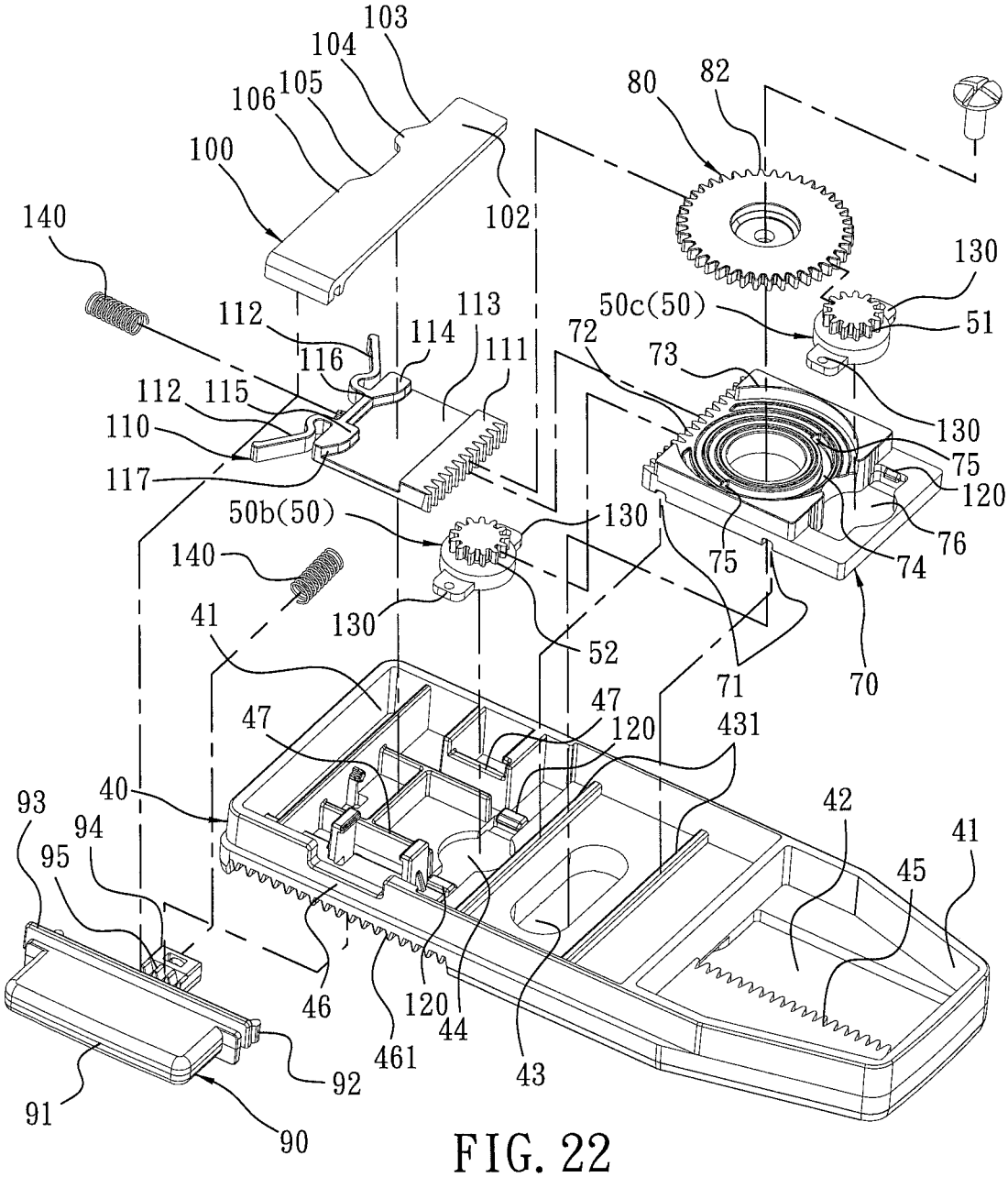
FIG. 22 is a partial enlarged view of the embodiment in FIG. 20 according to the present invention.

Refer to FIG. 15 and FIG. 16, a lateral surface of the armrest body 4 is arranged with an opening 4*a* while a lower opening 23 is disposed on a lateral side (inner side) of the armrest base 20 and is aligned with the opening 4*a*. As shown in FIG. 20 and FIG. 22, a fourth rack 461 is set on a side wall 46 over the lower opening 23 of the armrest base 20 and a platform 47 is disposed on the right side and the left side of the second groove 44 respectively.

The press member 90 is plugged into the opening 4*a* of the armrest body 4. A press portion 91 is arranged at an outer end of the press member 90 and a first elastic member 92 is set on an inner end of the press member 90 for leaning against a first protruding wall 231 on the lateral side of the lower opening 23 of the armrest base 20 elastically. A fore-and-aft slide bar 93 projecting upwards is set between the press portion 91 and the first elastic member 92 while a pin 94 projecting inwards is arranged at in inner wall of the slide bar 93. A third rack 95 is disposed on the pin 94 along the fore-and-aft direction and is engaged with the fourth rack 461 of the first component 40.

Figure 17:
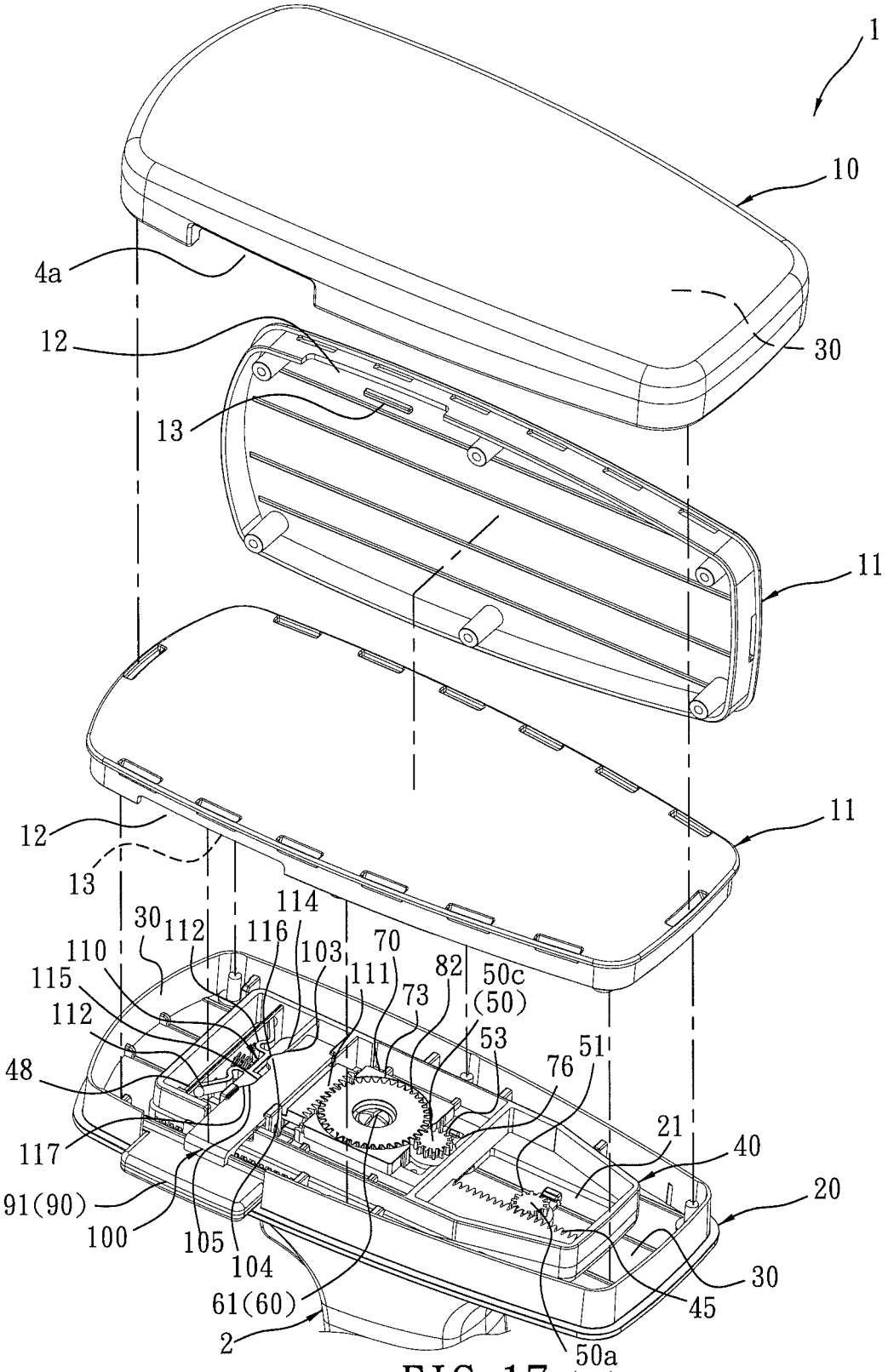
FIG. 17 is an explosive view of the embodiment in FIG. 15 according to the present invention.
Figure 18:
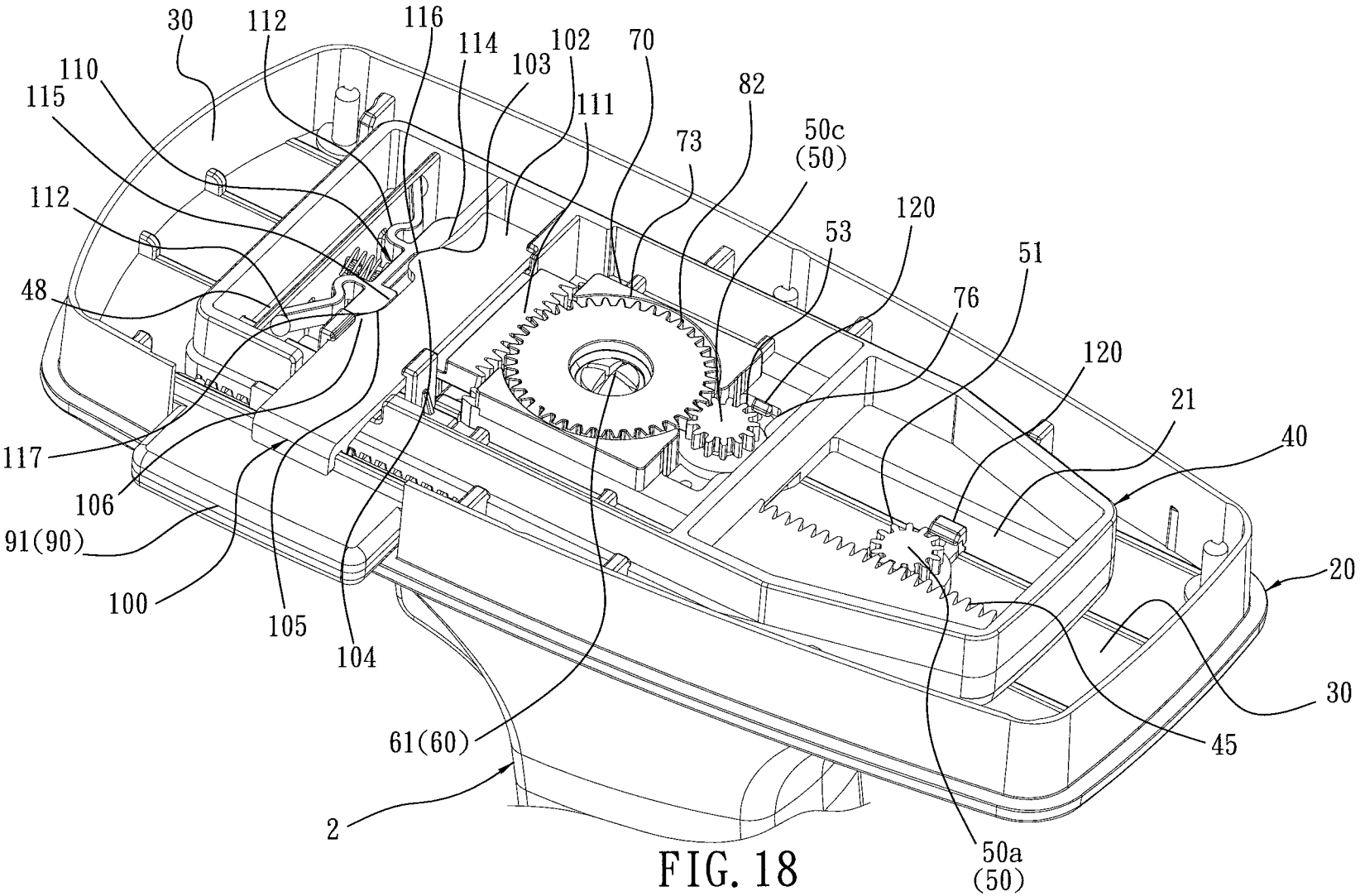
FIG. 18 is a partial enlarged view of the embodiment in FIG. 17 according to the present invention.
Figure 21:
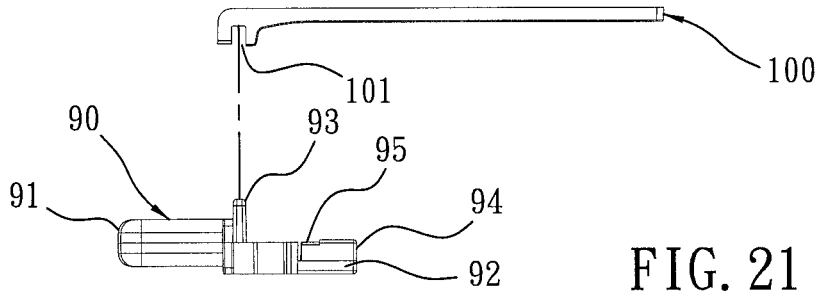
FIG. 21 is a schematic drawing showing an explosive side view of a press member and a control member according to the present invention.

Refer to FIG. 17, FIG. 21, and FIG. 22, the control member 100 is disposed on the platforms 47 of the first component 40 in the lateral direction. The control member 100 includes a second sliding groove 101 whose opening is facing downwards, and a plate part 102 on an inner end thereof. The slide bar 93 of the press member 90 can be moveably mounted in the second sliding groove 101 in the fore-and-aft direction. A first slanting groove 103, a first bump 104, a second slanting groove 105 and a second bump 106 are disposed on the control member 100 from one end of the control member 100 with the plate part 102 to an outer end of the control member 100 in turn.

The fastener 110 is set between the second groove 44 of the first component 40 and the platforms 47 and located under the control member 100. The fastener 110 includes a sixth rack 111 that is engaged with the second rack 72 of the first shaft cover 70 and the teeth 82 around the second shaft cover 80 simultaneously, a second elastic member 112 elastically leaning against a second protruding wall 48 near the platforms 47 of the first component 40, and a second recess 113 with an opening facing upwards and used for mounting the control member 100. One side of the fastener 110 corresponding to the control member 100 is disposed with a third bump 114, a third slanting groove 116, a fourth bump 115 and a fourth slanting groove 117 in turn from inside to outside. The third bump 114 and the fourth bump 115 are slid into the first slanting groove 103 and the second slanting groove 105 of the control member 100 respectively at the same time while the first bump 104 and the second hump 106 of the control member 100 are slid into the third slanting groove 116 and the fourth slanting groove 117 respectively and simultaneously. The third bump 114 and the fourth bump 115 are pressed against by the first bump 104 and the second hump 106 of the control member 100 respectively and simultaneously when the control member 100 is moved inwards.

Figure 23:
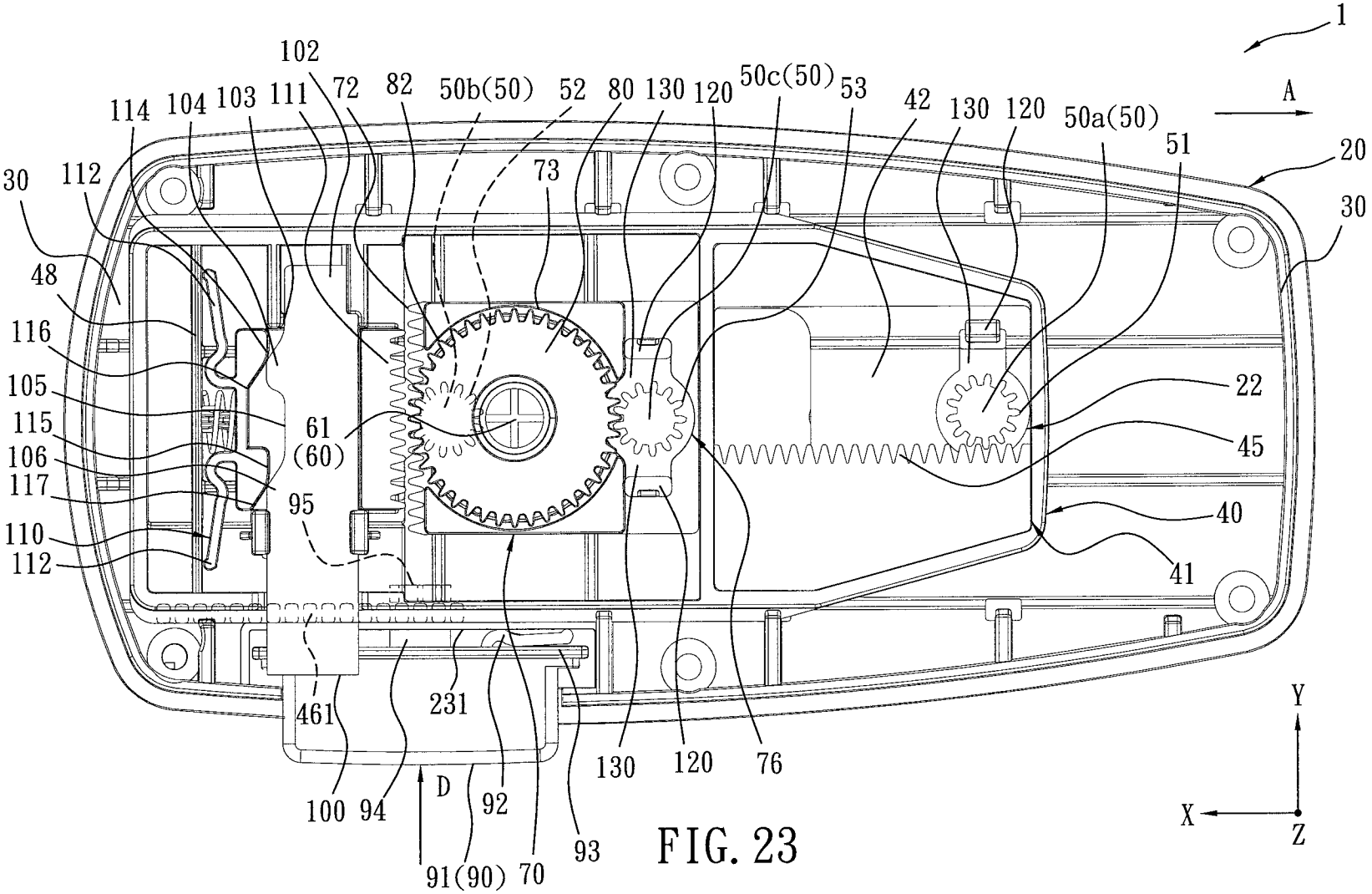
FIG. 23 is a top view of the embodiment in FIG. 19 in which an armrest is adjusted for lateral movement according to the present invention.

The third rack 95 on the pin 94 of the press member is moved inward to be released from the fourth rack 461 of the first component 40 when the press portion 91 of the press member 90 is pressed and moved inward elastically, away from the opening 4*a* (as the arrow D in FIG. 23 indicates).

The projecting shaft 61 remains stationary while the first rotary damper 51 of the first damper 50*a* is engaged with and moved along the first rack 45 when the armrest body 4 is moved forwards and backward for adjustment of the position. As the arrow A in FIG. 8 indicates, the armrest body 4 is moved and adjusted relative to the projecting shaft 61 in the fore-and-aft direction with the damping action. Now the slide bar 93 of the press member 90 simultaneously drives the control member 100 to move inward elastically. Thus the first bump 104 and the second bump 106 are released from the third slanting groove 116 and the fourth slanting groove 117 of the fastener 110 respectively to press against the third bump 114 and the fourth bump 115 respectively. Thereby the fastener 110 is forced to move forward and the sixth rack 111 is disengaged with the second rack 72 and the teeth 82 around the second shaft cover 80. The projecting shaft 61 remains stationary while the second rotary damper 52 of the second damper 50*b* is engaged with and slid along the second rack 72 when the armrest body 4 is adjusted in the lateral direction. As the arrow B in FIG. 9 indicates, the armrest body 4 is moved and adjusted relative to the projecting shaft 61 in the lateral direction with the damping action. The projecting shaft 61 remains stationary while the third rotary damper 53 of the third damper 50*c* is engaged with and rotated along the teeth 82 around the second shaft cover 80 when the armrest body 4 is rotated for adjustment. Thereby the armrest body 4 is rotated and adjusted relative to the projecting shaft 61 with the damping action, as the arrow C in FIG. 10 indicates.

Figure 19:
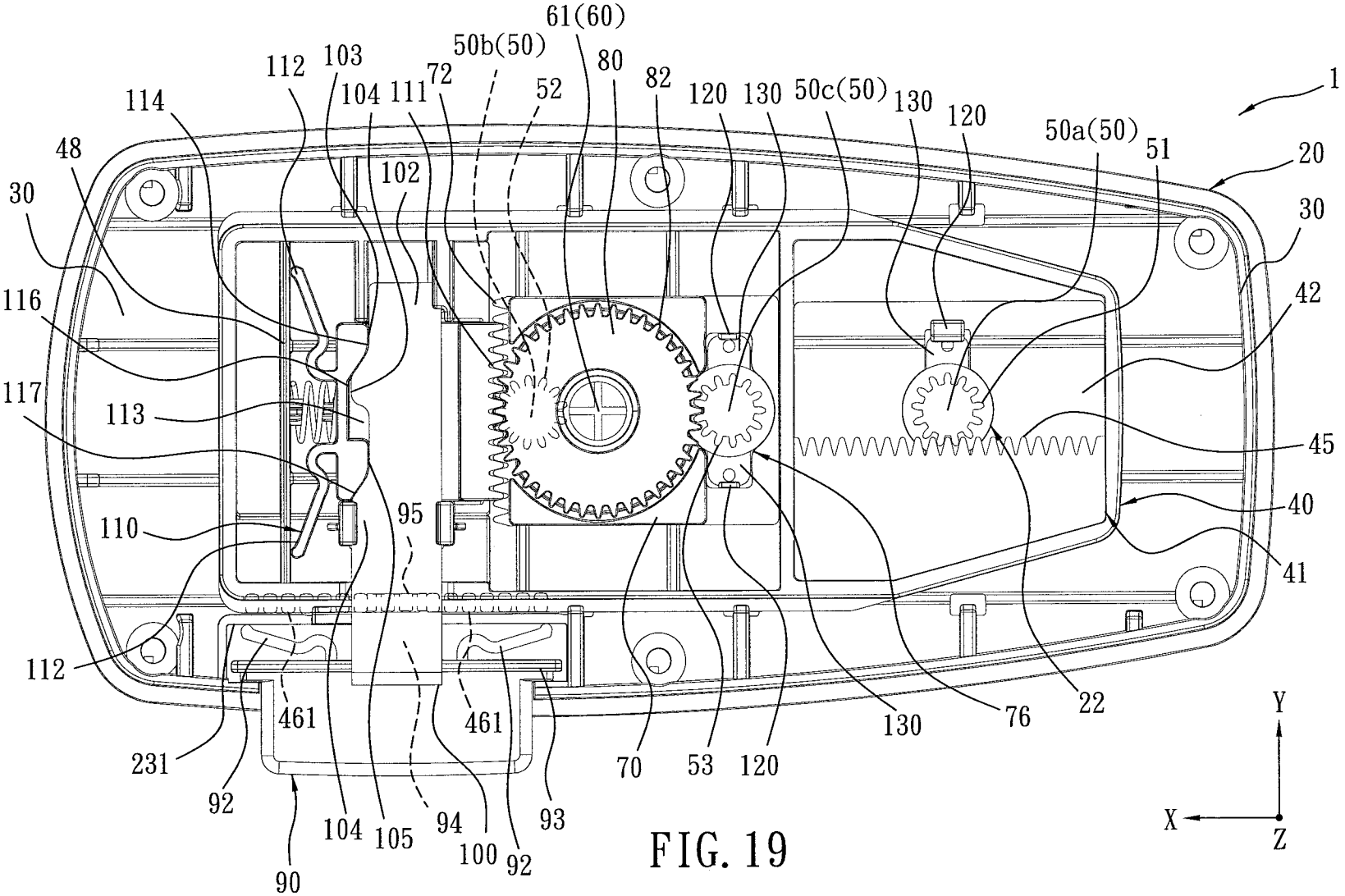
FIG. 19 is a top view of the embodiment in FIG. 18 according to the present invention.
Figure 24:
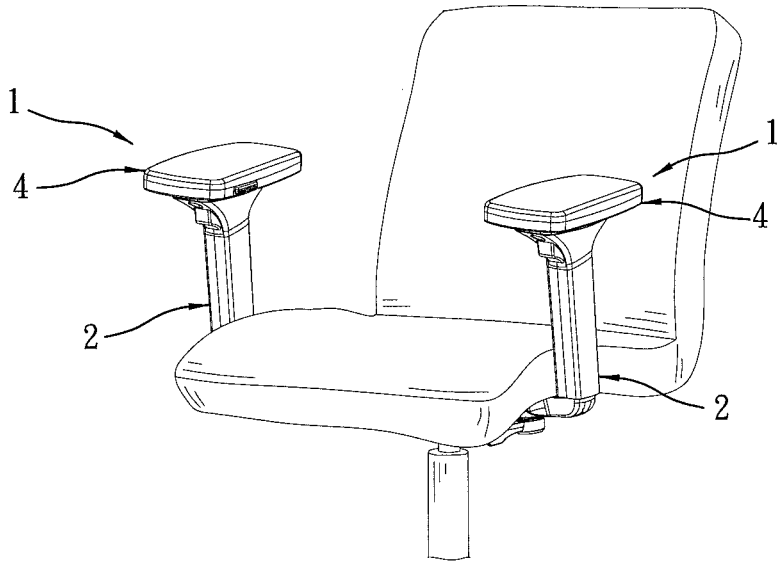
FIG. 24 is a schematic drawing showing a perspective view of an embodiment being set on a chair according to the present invention.

Refer to FIG. 19, the pin 94 of the press member 90 is moved outward and returned elastically and the third rack 95 of the press member 90 is also returned to be engaged with the fourth rack 461 of the first component 40 when the press portion 91 of the press member 90 is released and returned elastically. At the moment, the slide bar 93 of the press member 90 also drives the control member 100 to move outward elastically and turn back to the original position. Thus the fastener 110 is also returned elastically and the sixth rack 111 is engaged with the second rack 72 of the first shaft cover 70 and the teeth 82 around the second shaft cover 80 simultaneously. Therefore the armrest 1 is turned back to the fixed state, being positioned, as shown in FIG. 19 and FIG. 24.

As shown in FIG. 17, an upper opening 12 is disposed on a lateral side (inner side) of the armrest cover 11 of the armrest pad 10. The upper opening 12 is aligned with the lower opening 23 of the armrest base 20 and the opening 4*a* of the armrest body 4. The design of the upper opening 12 makes the movement of the press member 90 more smooth.

Still refer to FIG. 17, the upper opening 12 on the armrest cover 11 is further arranged with a stopping portion 13. The position of the stopping portion 13 is corresponding to the lower opening 23 of the armrest base 20 for stabilizing the control member 100, preventing the control member 100 from falling off.

Refer to FIG. 20 and FIG. 22, the press member 90 is further disposed with a spring 140 for increasing the elastic pressing on the first protruding wall 231 of the armrest base 20. The fastener 110 is also arranged with a spring 140 for increasing the elastic pressing on the second protruding wall 48 of the first component 40.

Figure 25:
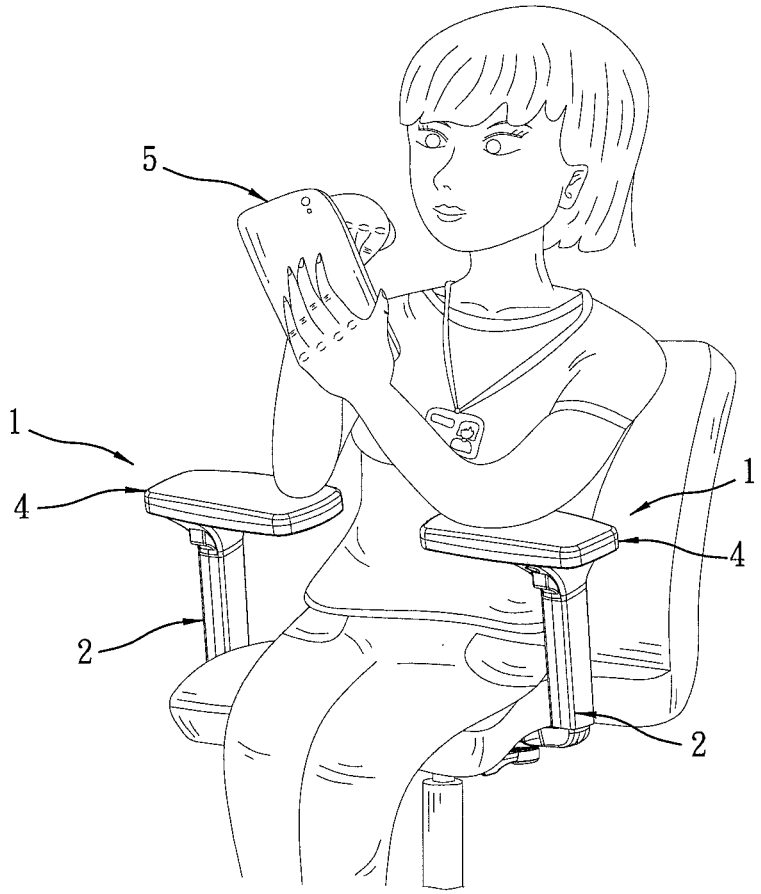
FIG. 25 is a schematic drawing showing the embodiment in FIG. 24 in use according to the present invention.

In summary, the armrest adjuster according to the present invention has the following advantages compared with the prior arts:

(1). The armrest body 4 of the present invention can be moved and adjusted in fore-and-aft direction or lateral direction, or rotated from side to side, on the top surface 3 of the armrest support 2 with/or without damping action. As shown in FIG. 24, FIG. 25 and FIG. 26, the present invention can meet users' demands effectively and the efficiency of the armrest is improved significantly.

(2). The height of the armrest pad (armrest body) in the side view can be reduced through proper arrangement of each component of the present invention. Not only the types of the armrest support used are not limited, the appearance of the whole chair is improved. This increases the purchase intention of chair manufacturers/or armrest support manufacturers to the present armrest.

(3). The armrest adjuster with a button (press member) of the present invention is formed by the button-free armrest adjuster being disposed with a press member 90, a control member 100 and a fastener 110. Thus the present invention can be changed into the armrest adjuster with a button or the button-free armrest adjuster easily according to users' needs. Thereby not only the production cost is reduced, this is beneficial to production management of manufacturing ends or suppliers.

(4). Only a few metal fasteners (such as screws) are required in the assembly by the present invention. Not only the assembly is simplified, the assembly cost is also reduced due to the minimum number of metal parts and accessories. This is also beneficial to the environment.

Additional advantages and modifications will readily occur to those skilled in the art. Therefore, the invention in its broader aspects is not limited to the specific details, and representative devices shown and described herein. Accordingly, various modifications may be made without departing from the spirit or scope of the general inventive concept as defined by the appended claims and their equivalent.

What is claimed is:

1. An armrest adjuster comprising an armrest disposed on a top surface of an armrest support; wherein the armrest includes:

an armrest pad fixed with an armrest cover in the armrest pad;

an al rarest base that is connected to the armrest cover of the armrest pad correspondingly to form an armrest body and is disposed with a first slot at a middle part of the armrest base in a forward-backward direction while a rectangular space is formed within the armrest body;

a first component that is mounted in the rectangular space of the armrest body and having a first recess in the first component while a second slot and a third slot are disposed in the first recess in the forward-backward direction and in a lateral direction respectively, and the third slot is located over the first slot;

a second component that is fixed between the armrest base and the top surface of the armrest support, and is disposed with a projecting shaft in the forward-backward direction while the projecting shaft is passed through both the first slot of the armrest base and the third slot of the first component;

a first shaft cover that is arranged at the projecting shaft of the second component and is located over the third slot of the first component so that the first component is able to be slid relative to the first shaft cover in the lateral direction;

a second shaft cover that is rotatably mounted in a circular recess on a top surface of the first shaft cover and is fixed on the projecting shaft of the second component; wherein the second shaft cover remains stationary while the first shaft cover is rotated with respect to the second shaft cover when the armrest body is rotated and moved relative to the projecting shaft for angle adjustment of the armrest body; thus the armrest body, the first component and the first shaft cover are synchronously rotated and moved relative to the second shaft cover for adjustment and then to be positioned at an angle after rotation; and at least one damper that is selected from the group consisting of a first damper, a second damper, a third damper, and a combination of the first damper, the second damper and the third damper;

wherein the armrest base is arranged with a first groove located beside the first slot in the forward-backward direction and a first damper is mounted in the first groove when the damper is the first damper; a first rack is disposed on one side of the second slot in the lateral direction and a first rotary damper of the first damper is passed through the second slot of the first component to be engaged with the first rack;

wherein the first recess of the first component is disposed with a second groove and a second damper is mounted in the second groove when the damper is the second damper; a second rotary damper of the second damper is engaged with a second rack on one side of the first shaft cover in the forward-backward direction;

wherein the first shaft cover is set with a third groove and a third damper is mounted in the third groove when the damper is the third damper; a third rotary damper of the third damper is engaged with teeth set circularly around the second shaft cover;

wherein the projecting shaft remains stationary and the first rotary damper of the first damper is engaged with and slid along the first rack when the armrest body is adjusted forward and backward in the forward-backward direction; thus the armrest body is moved and adjusted relative to the projecting shaft in the forward-backward direction with a damping action;

wherein the projecting shaft remains stationary and the second rotary damper of the second damper is engaged with and slid along the second rack when the armrest body is adjusted in the lateral direction; thus the armrest body is moved and adjusted relative to the projecting shaft in the lateral direction with the damping action;

wherein the projecting shaft remains stationary and the third rotary damper of the third damper is moved along the teeth around the second shaft cover when the armrest body is rotated for adjustment; thus the armrest body is rotated and adjusted relative to the projecting shaft with the damping action.

2. The device as claimed in claim 1, wherein the circular recess of the first shaft cover is arranged with a circular track that is set around the projecting shaft of the second component after being assembled; each of two ends of the circular track is disposed with a first stopper; wherein a positioning block is disposed on the second shaft cover and is mounted and slid in the circular track; the second shaft cover stops rotating when the positioning block is in contact with the first stopper; wherein an angle subtended by the circular track is limited so that the second shaft cover is able to rotate between the two first stoppers.

3. The device as claimed in claim 1, wherein at least one locking part is disposed on one lateral side of the first groove, the second groove or the third groove; at least one locked part is arranged at the first damper, the second damper or the third damper to be locked with the locking part correspondingly; thus the first damper, the second damper, or the third damper can be fixed on the first groove, the second groove or the third groove respectively and more stably by the locking part.

4. The device as claimed in claim 1, wherein at least one sliding groove is set on a front part or a rear part of a bottom surface of the first shaft cover while at least one first sliding rail corresponding to the sliding groove is disposed on the first component; thus the first shaft cover can be fit and slid over the first sliding rail smoothly in the lateral direction by the sliding groove.

5. An armrest adjuster comprising an armrest disposed on a top surface of an armrest support; wherein the armrest includes:

an armrest pad fixed with an armrest cover in the armrest pad;

an armrest base that is connected to the armrest cover of the armrest pad correspondingly to form an armrest body and is disposed with a first slot at a middle part of the armrest base in a forward-backward direction while a rectangular space is formed within the armrest body; wherein a lateral surface of the armrest body is arranged with an opening while a lower opening is disposed on a lateral side of the armrest base and is aligned with the opening;

a first component that is mounted in the rectangular space of the armrest body and having a first recess in the first component while a second slot and a third slot are disposed in the first recess in the forward-backward direction and in a lateral direction respectively, and the third slot is located over the first slot; wherein a fourth rack is set on a side wall over the lower opening of the armrest base and a platform is disposed on the right side and the left side of the second groove respectively;

a second component that is fixed between the armrest base and the top surface of the armrest support, and is disposed with a projecting shaft in the forward-backward direction while the projecting shaft is passed through both the first slot of the armrest base and the third slot of the first component;

a first shaft cover that is arranged at the projecting shaft of the second component and is located over the third slot of the first component so that the first component is able to be slid relative to the first shaft cover in the lateral direction;

a second shaft cover that is rotatably mounted in a circular recess on a top surface of the first shaft cover and is fixed on the projecting shaft of the second component that is passed through the third slot; wherein the second shaft cover remains stationary while the first shaft cover is rotated with respect to the second shaft cover when the armrest body is rotated and moved relative to the projecting shaft for angle adjustment of the armrest body; thus the armrest body, the first component and the first shaft cover are synchronously rotated and moved relative to the second shaft cover for adjustment and then to be positioned at an angle after rotation;

at least one damper that is selected from the group consisting of a first damper, a second damper, a third damper, and a combination of the first damper, the second damper and the third damper; wherein the armrest base is arranged with a first groove located beside the first slot in the forward-backward direction and a first damper is mounted in the first groove when the damper is the first damper; a first rack is disposed on one side of the second slot in the lateral direction and a first rotary damper of the first damper is passed through the second slot of the first component to be engaged with the first rack; wherein the first recess of the first component is disposed with a second groove and a second damper is mounted in the second groove when the damper is the second damper; a second rotary damper of the second damper is engaged with a second rack on one side of the first shaft cover in the forward-backward direction; wherein the first shaft cover is set with a third groove and a third damper is mounted in the third groove when the damper is the third damper; a third rotary damper of the third damper is engaged with teeth set circularly around the second shaft cover;

a press member that is plugged into the opening 4*a* of the armrest body and having a press portion on an outer end of the press member, a first elastic member set on an inner end of the press member for learning against a first protruding wall on a lateral side of the lower opening of the armrest base elastically, a slide bar projecting upward arranged between the press portion and the first elastic member in the forward-backward direction, a pin projecting inwards and disposed on an inner wall of the slide bar, and a third rack set on the pin in the forward-backward direction and engaged with the fourth rack of the first component;

a control member that is disposed on the platforms of the first component in the lateral direction and including a second sliding groove with an opening is facing downwards and movably fit on the slide bar of the press member, a plate part on an inner end of the control member, a first slanting groove, a first bump, a second slanting groove and a second bump disposed on the control member from the inner end to an outer end of the control member; wherein a third bump and a fourth bump are pressed against by the first bump and the second hump of the control member respectively and simultaneously when the control member is moved inwards; and a fastener that is disposed between the second groove of the first component and the platforms, located under the control member, and having a fifth rack that is engaged with both the second rack of the first shaft cover and the teeth around the second shaft cover, a second elastic member elastically leaning against a second protruding wall near the platforms of the first component, a second recess with an opening facing upwards and used for mounting the control member mounting the control member; wherein one side of the fastener corresponding to the control member is disposed with the third bump, a third slanting groove, the fourth bump and a fourth slanting groove in turn from inside to outside; wherein the third bump and the fourth bump are slid into the first slanting groove and the second slanting groove of the control member respectively at the same time while the first bump and the second hump of the control member are slid into the third slanting groove and the fourth slanting groove respectively and simultaneously;

wherein the third rack on the pin of the press member is moved inward to be released from the fourth rack of the first component when the press portion of the press member is pressed and moved inward elastically, away from the opening; the projecting shaft remains stationary while the first rotary damper of the first damper is engaged with and moved along the first rack when the armrest body is moved in the forward-backward direction for adjustment; thus the armrest body is moved and adjusted relative to the projecting shaft in the forward-backward direction with a damping action; the slide bar of the press member simultaneously drives the control member to move inward elastically so that the first bump and the second bump are released from the third slanting groove and the fourth slanting groove of the fastener respectively to press against the third bump and the fourth bump respectively; thereby the fastener is forced to move forward and the fifth rack is disengaged with the second rack and the teeth around the second shaft cover; the projecting shaft remains stationary while the second rotary damper of the second damper is engaged with and slid along the second rack when the armrest body is adjusted in the lateral direction; thus the armrest body is moved and adjusted relative to the projecting shaft in the lateral direction with the damping action; the projecting shaft remains stationary and the third rotary damper of the third damper is engaged with and rotated along the teeth around the second shaft cover when the armrest body is rotated for adjustment; thereby the armrest body is rotated and adjusted relative to the projecting shaft with the damping action;

wherein the pin of the press member is moved outward and returned elastically and the third rack of the press member is returned to be engaged with the fourth rack of the first component when the press portion of the press member is released and returned elastically; the slide bar of the press member simultaneously drives the control member to move outward elastically and turn back so that the fastener is returned elastically and the fifth rack is engaged with both the second rack of the first shaft cover and the teeth around the second shaft cover; thus the armrest is turned back to be fixed and positioned.

6. The device as claimed in claim 5, wherein the circular recess of the first shaft cover is arranged with a circular track that is set around the projecting shaft of the second component after being assembled; each of two ends of the circular track is disposed with a first stopper; wherein a positioning block is disposed on the second shaft cover and is mounted and slid in the circular track; the second shaft cover stops rotating when the positioning block is in contact with the first stopper; wherein an angle subtended by the circular track is limited so that the second shaft cover is able to rotate between the two first stoppers.

7. The device as claimed in claim 5, wherein at least one locking part is disposed on one lateral side of the first groove, the second groove or the third groove; at least one locked part is arranged at the first damper, the second damper or the third damper to be locked with the locking part correspondingly; thus the first damper, the second damper, or the third damper can be fixed on the first groove, the second groove or the third groove respectively and more stably by the locking part.

8. The device as claimed in claim 5, wherein at least one sliding groove is set on a front part or a rear part of a bottom surface of the first shaft cover while at least one first sliding rail corresponding to the sliding groove is disposed on the first component; thus the first shaft cover can be fit and slid over the first sliding rail smoothly in the lateral direction by the sliding groove.

9. The device as claimed in claim 5, wherein an upper opening is disposed on a lateral side of the armrest cover of the armrest pad, and is aligned with the lower opening of the armrest base and the opening of the armrest body.

10. The device as claimed in claim 9, wherein the upper opening of the armrest cover is further arranged with a stopping portion that is corresponding to the lower opening of the armrest base.

* * * * *